US007605527B2

(12) United States Patent
Sakai et al.

(10) Patent No.: US 7,605,527 B2
(45) Date of Patent: Oct. 20, 2009

(54) DISCHARGE LAMP AND DISCHARGE ELECTRODE HAVING AN ELECTRON-EMITTING LAYER INCLUDING A PLURALITY OF PROTRUSIONS SEPARATED BY GROOVES

(75) Inventors: Tadashi Sakai, Yokohama (JP); Tomio Ono, Yokohama (JP); Naoshi Sakuma, Yokohama (JP); Hiroaki Yoshida, Yokohama (JP); Mariko Suzuki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 606 days.

(21) Appl. No.: 11/140,222

(22) Filed: May 31, 2005

(65) Prior Publication Data

US 2005/0264157 A1 Dec. 1, 2005

(30) Foreign Application Priority Data

May 31, 2004 (JP) ..... 2004-162102

(51) Int. Cl.
*H01J 1/00* (2006.01)
*H01J 61/04* (2006.01)

(52) U.S. Cl. ..... 313/311; 313/633

(58) Field of Classification Search ..... None
See application file for complete search history.

(56) References Cited

U.S. PATENT DOCUMENTS

| | | | |
|---|---|---|---|
| 6,781,294 | B2 | 8/2004 | Sakai et al. |
| 7,026,750 | B2 * | 4/2006 | Nishibayashi et al. ... 313/346 R |
| 2004/0061429 | A1 | 4/2004 | Sakai et al. |
| 2005/0017644 | A1 | 1/2005 | Ono et al. |
| 2005/0062392 | A1 | 3/2005 | Sakai et al. |
| 2005/0264157 | A1 | 5/2005 | Sakai et al. |

FOREIGN PATENT DOCUMENTS

| | | |
|---|---|---|
| JP | 8-339779 | 12/1996 |
| JP | 9-185942 | 7/1997 |
| JP | 9-199001 | 7/1997 |
| JP | 9-265892 | 10/1997 |
| JP | 10-69868 | 3/1998 |
| JP | 10-283914 | 10/1998 |
| JP | 11-111218 | 4/1999 |
| JP | 11-144677 | 5/1999 |

(Continued)

OTHER PUBLICATIONS

U.S. Appl. No. 11/075,883, filed Mar. 3, 2005, Tomio Ono.

(Continued)

*Primary Examiner*—Toan Ton
*Assistant Examiner*—Britt Hanley
(74) *Attorney, Agent, or Firm*—Oblon, Spivak, McClelland, Maier & Neustadt, L.L.P.

(57) ABSTRACT

A discharge lamp encompassing a sealed-off tube filled with a discharge gas and a discharge electrode provided in the sealed-off tube. The discharge electrode embraces a supporting base and an electron-emitting layer formed of a wide bandgap semiconductor and provided on the supporting base, implemented by a plurality of protrusions, at least part of surfaces of the protrusions are unseen from a perpendicular direction to thereof above a top surface of the electron-emitting layer, dangling bonds of the wide bandgap semiconductor at the surfaces are terminated with hydrogen atoms.

16 Claims, 12 Drawing Sheets

FOREIGN PATENT DOCUMENTS

| | | |
|---|---|---|
| JP | 11-195371 | 7/1999 |
| JP | 2000-106130 | 4/2000 |
| JP | 2001-348296 | 12/2001 |
| JP | 2002-25421 | 1/2002 |
| JP | 2002-25499 | 1/2002 |
| JP | 2002-298777 | 10/2002 |
| JP | 2003-132850 | 5/2003 |
| JP | 2003-263952 | 9/2003 |
| JP | 2003-281991 | 10/2003 |
| JP | 2004-14214 | 1/2004 |
| JP | 2004-119019 | 4/2004 |
| JP | 2004-119175 | 4/2004 |
| JP | 2004-119241 | 4/2004 |
| JP | 2004-139762 | 5/2004 |
| WO | WO 01/71759 A1 | 9/2001 |

OTHER PUBLICATIONS

U.S. Appl. No. 11/366,468, filed Mar. 3, 2006, Ono et al.
U.S. Appl. No. 11/467,439, filed Aug. 25, 2006, Ono, et al.

* cited by examiner

DISCHARGE LAMP AND DISCHARGE ELECTRODE HAVING AN ELECTRON-EMITTING LAYER INCLUDING A PLURALITY OF PROTRUSIONS SEPARATED BY GROOVES

CROSS REFERENCE TO RELATED APPLICATIONS AND INCORPORATION BY REFERENCE

This application claims benefit of priority under 35 USC 119 based on Japanese Patent Application No. P2004-162102 filed May 31, 2004, the entire contents of which are incorporated by reference herein.

BACKGROUND OF THE INVENTION

1. Field of the Invention

The instant invention relates to a discharge electrode utilizing an electron-emitting layer, and a discharge lamp utilizing the discharge electrode.

2. Description of the Related Art

Discharge lamps have been widely used as a general use light source, an industrial light source, and various integrative light sources. Above all, a low voltage discharge lamp such as a fluorescent lamp has a big market dominating approximately half of the illuminative light source market. With these discharge lamps including the fluorescent lamp that form a big market, recent demands for resource saving, reduction in environmental load and the like in addition to consideration for energy saving such as luminous efficiency have been increasing. In regards to energy saving, obtaining higher luminescence intensity from the same energy is desired. There is particularly a strong market demand for cold-cathode discharge lamps for backlights and the like as they are relatively less efficient than thermal types.

Development of cathode materials is being actively conducted for resolving these issues. The search for a material that allows continuous electric discharge at a lower operating voltage than conventionally used nickel (Ni) continues, where various metals, semiconductors, and oxides are being tested. A fluorescent luminescent device employing a thermionic emission cathode, which has diamond particles provided on the surface of a cathode material such as tungsten (W), tantalum (Ta) or the like, is proposed in Japanese Patent Application Laid-open No. Hei 10-69868 and Japanese Patent Application Laid-open No. 2000-106130.

Furthermore, technology using diamond having negative or significantly smaller electron affinity than a metal electrode, graphite having sp2 bond and formed of the same carbon as the diamond, or carbon-based material having a grain boundary layer of amorphous carbon as the cold-cathode electrode is proposed in Japanese Patent Application Laid-open No. 2002-298777.

However, with the technologies disclosed in Japanese Patent Application Laid-open No. Hei 10-69868 and Japanese Patent Application Laid-open No. 2000-106130, most of the supplied electric power is consumed by the cathode material, not always showing sufficient improvement in efficiency.

Meanwhile, with the technology disclosed in Japanese Patent Application Laid-open No. 2002-298777, higher efficiency can be achieved than with the technologies disclosed in Japanese Patent Application Laid-open No. Hei 10-69868 and Japanese Patent Application Laid-open No. 2000-106130 since carbon-based electrodes having diamond layers and graphite or amorphous carbon layers are used instead of metallic electrodes made of Ni or the like, which are conventionally used as the cold-cathode electrodes. However, problems remain due to electric discharge from discharge lamps and wear-out of electrodes through sputtering due to Ar ion bombardment, resulting in a short lifetime without being able to maintain high efficiency over a long period of time.

SUMMARY OF THE INVENTION

In view of these situations, it is an object of the present invention to provide a discharge electrode utilizing an electron-emitting layer facilitating a highly efficient secondary-electron emission and a longer lifetime, and various discharge lamps utilizing the discharge electrode.

An aspect of the present invention may inhere in a discharge lamp encompassing a sealed-off tube filled with a discharge gas and a discharge electrode provided in the sealed-off tube. Here, the discharge electrode embraces a supporting base, and an electron-emitting layer formed of a wide bandgap semiconductor and provided on the supporting base, implemented by a plurality of protrusions, at least part of surfaces of the protrusions are unseen from a perpendicular direction to thereof above a top surface of the electron-emitting layer, dangling bonds of the wide bandgap semiconductor at the surfaces are terminated with hydrogen atoms.

Another aspect of the present invention may inhere in a discharge lamp encompassing a sealed-off tube filled with a discharge gas, an electron-emitting layer including a supporting base formed of a wide bandgap semiconductor and provided on the inner surface of the sealed-off tube, and a plurality of protrusions provided on the supporting base, each of the protrusions having a top end face and sidewalls, the sidewalls are unseen from a perpendicular direction above the top end face, dangling bonds of the wide bandgap semiconductor at the sidewalls are terminated with hydrogen atoms, and an external discharge electrode provided on the outer surface of the sealed-off tube, opposing to the electron-emitting layer.

Still another aspect of the present invention may inhere in a discharge electrode configured to be assembled in a sealed-off tube of a discharge lamp, encompassing a supporting base and an electron-emitting layer formed of a wide bandgap semiconductor and provided on the supporting base, implemented by a plurality of protrusions, at least part of surfaces of the protrusions are unseen from a perpendicular direction above a top surface of the electron-emitting layer, dangling bonds of the wide bandgap semiconductor at the surfaces are terminated with hydrogen atoms.

DETAILED DESCRIPTION OF THE INVENTION

Figure 1:
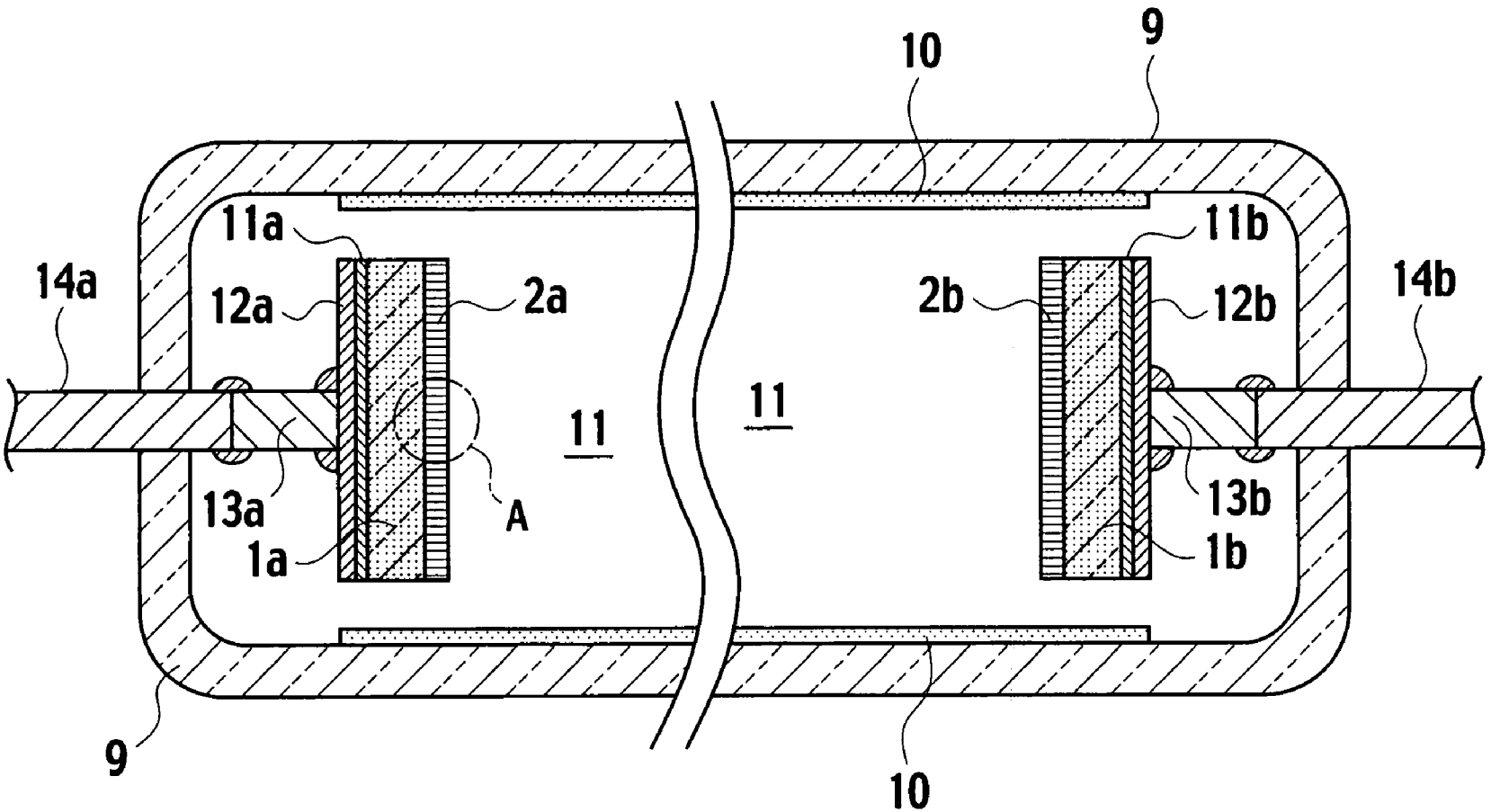
FIG. 1 is a schematic cross-section describing an outline of a discharge lamp, according to a first embodiment of the present invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified. Generally and as it is conventional in the representation of electronic devices, it will be appreciated that the various drawings are not drawn to scale from one figure to another nor inside a given figure, and in particular that the layer thicknesses are arbitrarily drawn for facilitating the reading of the drawings.

In the following description specific details are set forth, such as specific materials, process and equipment in order to provide a thorough understanding of the present invention. It will be apparent, however, to one skilled in the art that the present invention may be practiced without these specific details. In other instances, well-known manufacturing materials, process and equipment are not set forth in detail in order not to unnecessary obscure the present invention. Prepositions, such as "on", "over", "under", "beneath", and "normal" are defined with respect to a planar surface of the substrate, regardless of the orientation in which the substrate is actually held. A layer is on another layer even if there are intervening layers.

First Embodiment

As shown in FIG. 1, a discharge lamp according to a first embodiment of the present invention encompasses a sealed-off tube 9 filled with a discharge gas 11, a fluorescent film 10, which is coated with a thickness of 50 μm to 300 μm to part of the inner wall of the sealed-off tube 9, and a pair of discharge electrodes (2*a*, 1*a*, 11*a*, 12*a*; 2*b*, 1*b*, 11*b*, 12*b*), which is provided in the inside of the sealed-off tube 9 at both sides. The sealed-off tube 9 may be a glass tube made of soda lime glass, boron silicate glass or the like, for example.

Of the pair of discharge electrodes (2*a*, 1*a*, 11*a*, 12*a*; 2*b*, 1*b*, 11*b*, 12*b*), a first discharge electrode (2*a*, 1*a*, 11*a*, 12*a*) on the left side of FIG. 1 encompasses a wide bandgap semiconductor substrate 1*a* as a "supporting base", an electron-emitting layer 2*a* formed as an emitter at the top surface of the wide bandgap semiconductor substrate (supporting base) 1*a*, a bottom electrode 11*a* formed on the bottom surface of the wide bandgap semiconductor substrate 1*a*, and a refractory metal plate 12*a* formed on the bottom surface of the bottom electrode 11*a*. In addition, a refractory metal rod 13*a* is welded and electrically connected to the refractory metal plate 12*a*. The refractory metal rod 13*a* is a cylindrical rod made of a refractory metal such as tungsten (W) or molybdenum (Mo) and is welded to another cylindrical rod of a lead-in sealed wire 14*a*. The lead-in sealed wire 14*a* may be formed of, for example, Kovar (Fe54%—Ni29%—Co17% alloy). The lead-in sealed wire 14*a* passes through the metal-to-glass seal of the sealed-off tube 9.

The "wide bandgap semiconductor" has been studied since beginning of the semiconductor industry, and in general represents a semiconductor material having a wider bandgap Eg than silicon (bandgap Eg is approximately 1.1 eV at 300 degrees Kelvin), gallium arsenide (bandgap Eg is approximately 1.4 eV at 300 degrees Kelvin), or the like which have been put into practical use in the earlier stage of the semiconductor technology. For example, zinc telluride (ZnTe) with a bandgap Eg of approximately 2.2 eV at 300 degrees Kelvin, cadmium sulfide (CdS) with a bandgap Eg of approximately 2.4 eV, zinc selenide (ZnSe) with a bandgap Eg of approximately 2.7 eV, gallium nitride (GaN) with a bandgap Eg of approximately 3.4 eV, zinc sulfide (ZnS) with a bandgap Eg of approximately 3.7 eV, diamonds with a bandgap Eg of approximately 5.5 eV, and aluminum nitride (AlN) with a bandgap Eg of approximately 5.9 eV, are representative examples of wide bandgap semiconductors. In addition, silicon carbide (SiC) is also an example of a wide bandgap semiconductor. Bandgaps Eg for various polytypes of SiC at 300 degrees Kelvin are reported such as approximately 2.23 eV for 3C-SiC, 2.93 eV for 6H-SiC, and 3.26 eV for 4H-SiC, and other various polytypes of SiC are also available. Furthermore, a mixed crystal made up of a combination of two or more of the above-mentioned various wide bandgap semiconductors may also be employed. In any case, in the specification, 'wide bandgap semiconductor' means a semiconductor with a bandgap of nearly 2.2 eV or greater at 300 degrees Kelvin. Among these wide bandgap semiconductors and mixed crystals, the wide bandgap semiconductor and mixed crystals having a bandgap of 3.4 eV or greater at 300 degrees Kelvin is particularly favorable as an electron emitter, because the negative electron affinity is large.

Similarly, the other one of the pair of discharge electrodes (2*a*, 1*a*, 11*a*, 12*a*; 2*b*, 1*b*, 11*b*, 12*b*), namely a second discharge electrode (2*b*, 1*b*, 11*b*, 12*b*) on the right side of FIG. 1 encompasses a wide bandgap semiconductor (wide gap semiconductor) substrate 1*b* as a supporting base, an electron-emitting layer 2*b* formed as an emitter at the top surface of the wide bandgap semiconductor substrate 1*b*, a bottom electrode 11*b* formed on the bottom surface of the wide bandgap semiconductor substrate 1*b*, and a refractory metal plate 12*b* formed on the bottom surface of the bottom electrode 11*b*. In addition, a refractory metal cylindrical rod 13*b* is welded and electrically connected to the refractory metal plate 12*b*. The refractory metal rod 13*b* is welded to a lead-in sealed wire 14*b*, and the lead-in sealed wire 14*b* implements a metal-to-glass seal of the sealed-off tube 9. The lead-in sealed wire 14*b* may be formed of, for example, Kovar. The pair of discharge electrodes (2*a*, 1*a*, 11*a*, 12*a*; 2*b*, 1*b*, 11*b*, 12*b*) is not particularly limited in shape and may adopt various shapes such as a rectangular plate, a dish, a cylindrical rod, a wire or the like.

Figure 2A:
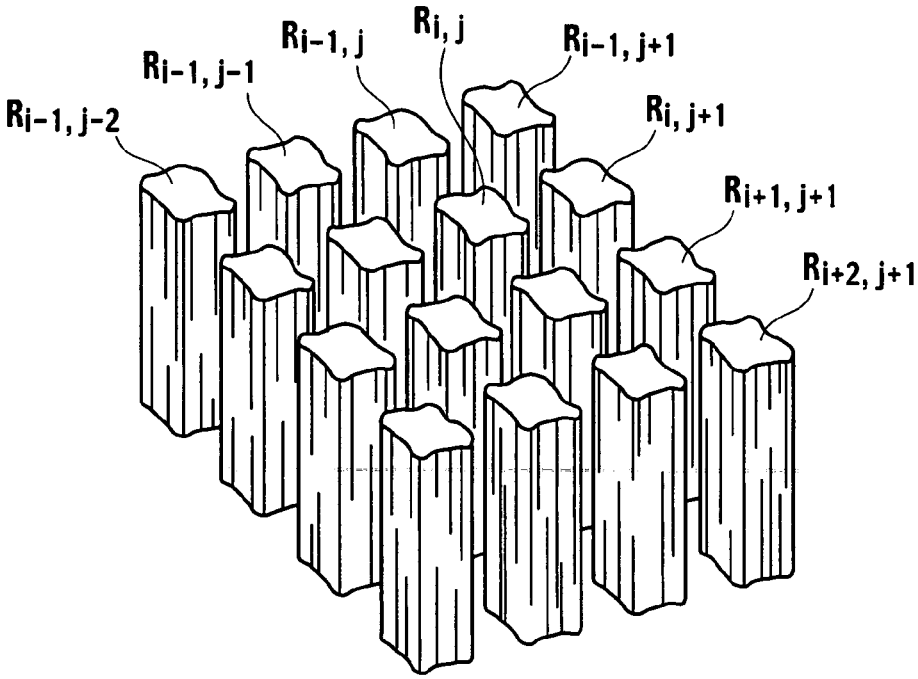
FIG. 2A is a fragmentary bird's eye view illustrating part of an electron-emitting layer 2*a* allocated in a circle labeled "A" in FIG. 1, the electron-emitting layer implements a first discharge electrode according to the first embodiment of the present invention.

FIG. 2A is a band diagram illustrating part of an electron-emitting layer 2*a* located in a circle labeled "A" of the first discharge electrode (2*a*, 1*a*, 11*a*, 12*a*) shown on the left side of FIG. 1, and shows an example where wide bandgap semiconductor pillars $R_{i-1,j-2}$, $R_{i-1,j-1}$, $R_{i-1,j}$, and $R_{i-1,j+1}$, . . . , $R_{i,j-2}$, $R_{i,j-1}$, $R_{i,j}$, $R_{i,j+1}$, . . . are formed separated by grooves running vertically and horizontally in a matrix. As shown in FIG. 2A, the top end faces of respective wide bandgap semiconductor pillars $R_{i-1,j-2}$, $R_{i-1,j-1}$, $R_{i-1,j}$, and $R_{i-1,j+1}$, . . . , $R_{i,j-2}$, $R_{i,j-1}$, $R_{i,j}$, $R_{i,j+1}$, . . . have randomly shaped surfaces while FIG. 2B shows the configuration of FIG. 2A in schematic form with rectangular parallelepiped shapes.

Figure 2B:
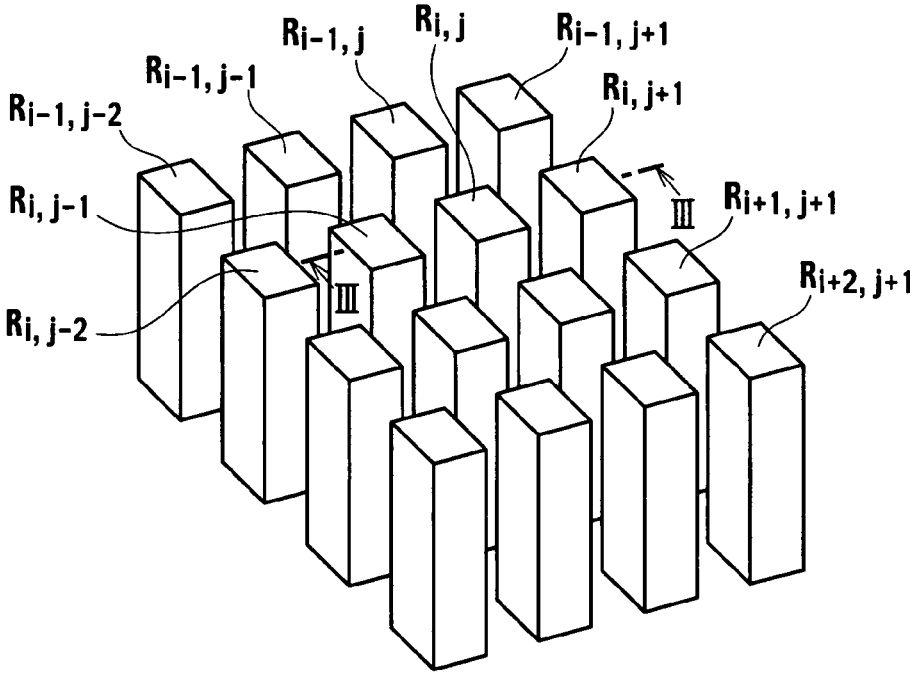
FIG. 2B is a fragmentary bird's eye view illustrating FIG. 2A in schematic form with rectangular parallelepiped shapes.
Figure 3:
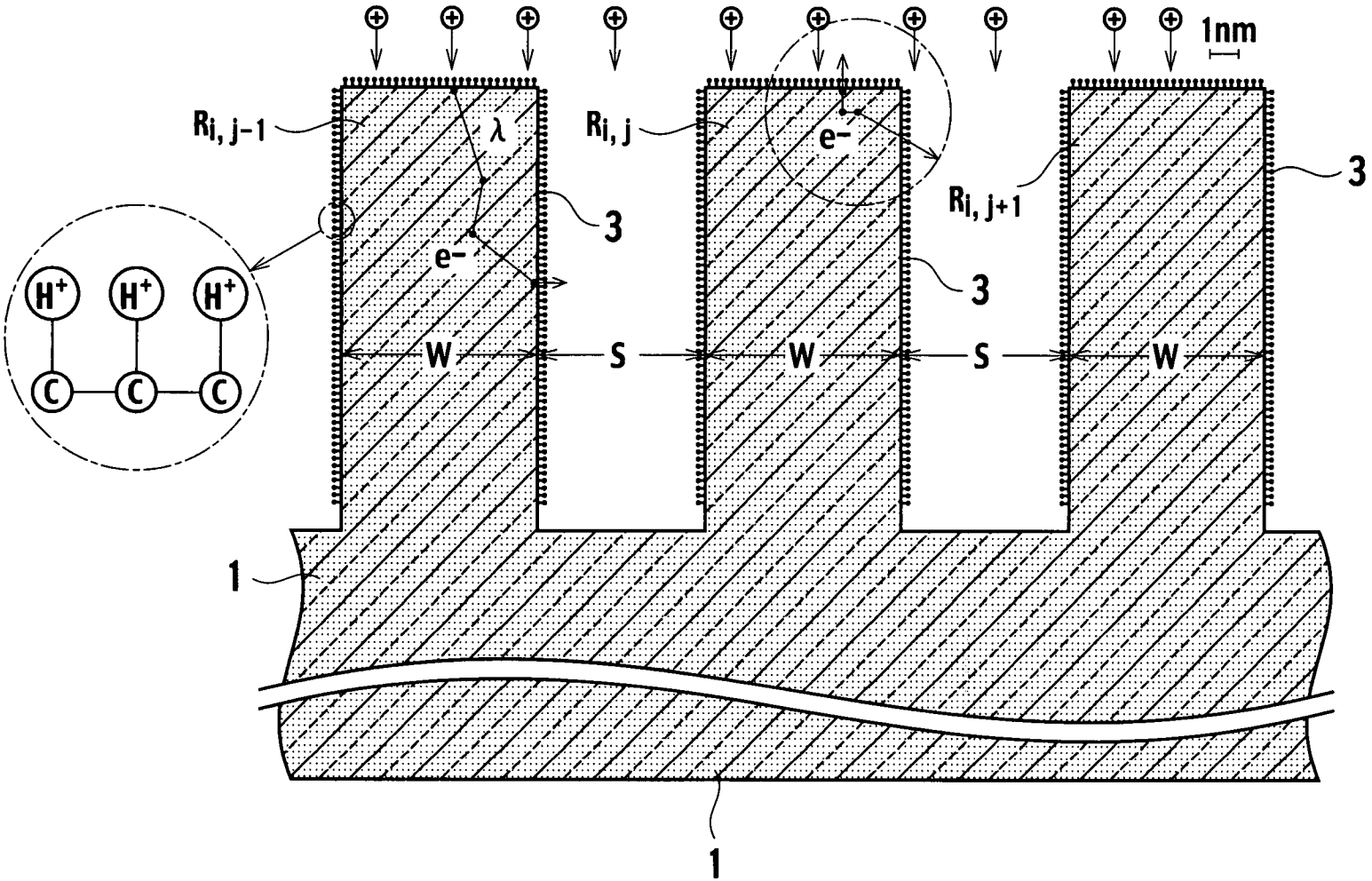
FIG. 3 is a cross-sectional view taken on line III-III in FIG. 2B, showing details of rectangular parallelepiped pillars $R_{ij-1}$, $R_{i,j}$, and $R_{i,j+1}$.

FIG. 3 is a cross-sectional view cut along respective centers of the rectangular parallelepiped pillars $R_{i,j-2}$, $R_{i,j-1}$, $R_{i,j}$, and $R_{i,j+1}$ of FIG. 2B. The wide bandgap semiconductor pillars $R_{i,j-2}$, $R_{i,j-1}$, $R_{i,j}$, respectively define a geometry of protrusion. At least part of the surface of the protrusion is unseen from a perpendicular direction to a top surface of the electron-emitting layer 2*a* above the top surface of the electron-emitting layer 2*a*. Each of the protrusions has a top end face and sidewalls. The top end face faces toward the second discharge electrode. The topology of the protrusion is so formed that sidewalls or side surfaces of the protrusion is unseen from above the top end face. Dangling bonds at the surface of the wide bandgap semiconductor (wide gap semiconductor substrate) 1 exposed at the sidewalls of the wide bandgap semiconductor pillars $R_{i,j-2}$, $R_{i,j-1}$, $R_{i,j}$ are subjected to hydrogen-termination treatment, forming the electron-emitting layer 2*a*. The rectangular parallelepiped pillars $R_{i,j-2}$, $R_{i,j-1}$, $R_{i,j}$ with width W are respectively separated by grooves with space S, and the dangling bonds on the sidewalls (vertical sidewalls) of pillars $R_{i,j-2}$, $R_{i,j-1}$, $R_{i,j}$ are terminated with the hydrogen ($H^+$) 3. With the first discharge electrode (2*a*, 1*a*, 11*a*, 12*a*), according to the first embodiment of the present invention as shown in FIGS. 2 and 3, multiple sidewalls parallel to an electric field, which is perpendicular to the principal surface of the first discharge electrode, are provided and the dangling bonds at these sidewalls are subjected to hydrogen-termination treatment. Therefore, the probability of ion-bombarded hydrogen-desorption is reduced. Note that the second discharge electrode (2*b*, 1*b*, 11*b*, 12*b*) on the right side of FIG. 1 does not need to have the structure shown in FIGS. 2 and 3. However, there is a merit of making a symmetrical structure of the first discharge electrode (2*a*, 1*a*, 11*a*, 12*a*) and the second discharge electrode (2*b*, 1*b*, 11*b*, 12*b*) in that when the first discharge electrode (2*a*, 1*a*, 11*a*, 12*a*) reaches the end of its life cycle, the results of the hydrogen-termination treatment for the dangling bonds at the sidewalls may be utilized if the first discharge electrode (2*a*, 1*a*, 11*a*, 12*a*) and the second discharge electrode (2*b*, 1*b*, 11*b*, 12*b*) are interchanged.

In other words, in the discharge lamp according to the first embodiment of the present invention, since ions accelerated by cathode dark spaces near the primary surfaces of the first discharge electrode (2*a*, 1*a*, 11*a*, 12*a*) collide into the first discharge electrode surface, even if the hydrogen 3 terminating the dangling bonds at the top end faces desorbs, the terminating hydrogen remains on the sidewalls of the wide bandgap semiconductor pillars $R_{i-1,j-2}$, $R_{i-1,j-1}$, $R_{i-1,j}$, and $R_{i-1,j+1}$, . . . , thereby reducing, as a whole, the probability of ion-bombarded hydrogen-desorption. Since it is difficult for the hydrogen 3 to desorb from the sidewalls of the wide bandgap semiconductor pillars $R_{i-1,j-2}$, $R_{i-1,j-1}$, $R_{i-1,j}$, and $R_{i-1,j+1}$, . . . , electron affinity $\chi$ at respective sidewalls of the wide bandgap semiconductor pillars $R_{i-1,j-2}$, $R_{i-1,j-1}$, $R_{i-1,j}$, and $R_{i-1,j+1}$, . . . can be kept small, maintaining a state where electrons can easily be emitted. In addition, secondary-electron emission to the outside of the wide bandgap semiconductor pillars $R_{i-1,j-2}$, $R_{i-1,j-1}$, $R_{i-1,j}$, and $R_{i-1,j+1}$, . . . , through the Auger neutralizing process based on the potential energy of the bombarding ions, may be effectively carried out.

Figure 4A:
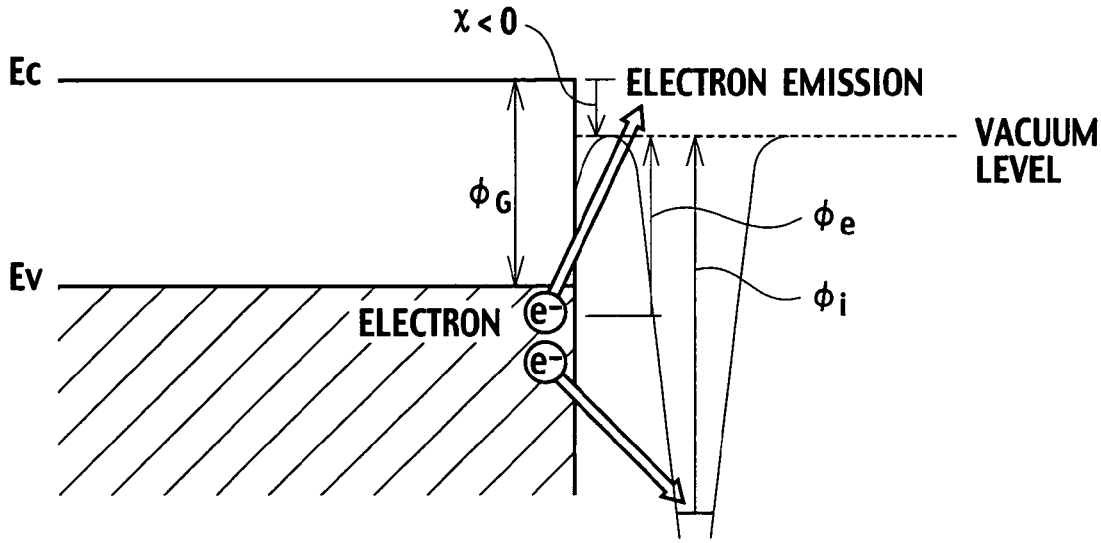
FIG. 4A is an energy band diagram illustrating a mechanism for electron emission from the first discharge electrode formed of a wide bandgap semiconductor for a case where electron affinity $\chi$ is negative.
Figure 4B:
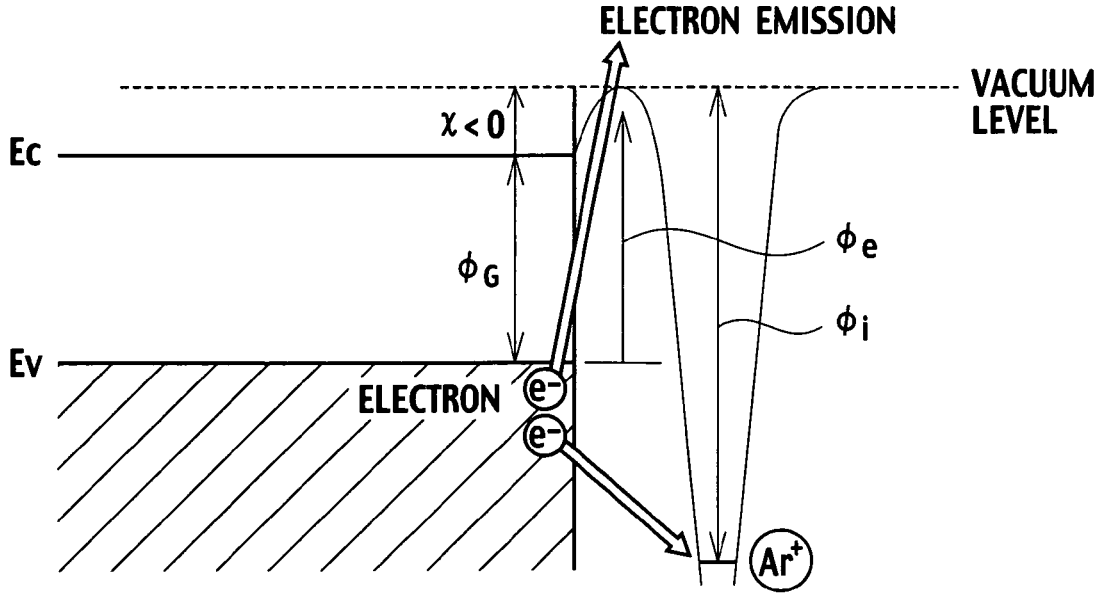
FIG. 4B is another energy band diagram illustrating a mechanism for electron emission for a case where electron affinity $\chi$ is positive.

FIG. 4A is a band diagram illustrating a mechanism of electron emission from the first discharge electrode formed of a wide bandgap semiconductor. Secondary-electron emission from the surface of the wide band semiconductor is said to mainly be ascribable to the Auger neutralizing process, when electrons jump out towards ions of a noble gas 11. In this case, electrons are emitted when $$\phi_i > 2(\phi_G + \chi \quad (1)$$

where $\phi_i$ denotes ionized energy, $\phi_G$ denotes bandgap, and $\chi$ denotes electron affinity. In other words, electron affinity $\chi$ greatly contributes to emission. Therefore, as shown in FIG. 4B, if the electron affinity $\chi$ takes a positive value, electron emission drastically reduces.

When the dangling bonds at the surface of the wide bandgap semiconductor have been subjected to hydrogen-termination treatment, $\chi<0$ or negative electron affinity (NEA) is surely acquired.

With the electron-emitting layer 2*a* of the discharge lamp, according to the first embodiment of the present invention, even if desorption of the hydrogen atoms 3 from the primary surfaces occurs by the ion bombardment, because many sidewalls (vertical sidewalls) are provided to fine pores $H_{i-1,j}, \ldots, H_{i,j}, \ldots, H_{i+2,j}, \ldots$, so as to preserve the sidewall surface having a small electron affinity $\chi$ by subjecting the dangling bonds at the sidewalls to hydrogen-termination treatment, providing the hydrogen terminated sidewall surface near a region where electrons are generated, a higher probability for the electrons to approach the NEA surface before returning back to the ground state energy level is achieved and the emission of electrons to the outside of the electron-emitting layer 2*a* is promoted.

Width W of the wide bandgap semiconductor pillars $R_{i-1,j-2}$, $R_{i-1,j-1}$, $R_{i-1,j}$, and $R_{1-1,j+1}, \ldots$ is preferably a distance that excited electrons, which are generated through Auger neutralization near the top end faces of the wide bandgap semiconductor pillars $R_{i-1,j-2}$, $R_{i-1,j-1}$, $R_{i-1,j}$, and $R_{i-1,j+1}, \ldots$, can reach the sidewalls of the wide bandgap semiconductor pillars $R_{i-1,j-2}$, $R_{i-1,j-1}$, $R_{i-1,j}$, and $R_{i-1,j+1}, \ldots$ within a relaxation time.

Furthermore, the first discharge electrode (2*a*, 1*a*, 11*a*, 12*a*), according to the first embodiment of the present invention, has width W of the wide bandgap semiconductor pillars $R_{i-1,j-2}$, $R_{i-1,j-1}$, $R_{i-1,j}$, and $R_{i-1,j+1}, \ldots$ selected so that electrons, which are generated due to the ions bombarded on the top end faces of the wide bandgap semiconductor pillars $R_{i-1,j-2}$, $R_{i-1,j-1}$, $R_{i-1,j}$, and $R_{i-1,j+1} \ldots$ or the primary surfaces of the electron-emitting layer 2*a* in the first discharge electrode, can reach the sidewalls (vertical sidewalls) within an electron movable distance within a crystal (i.e., mean free path $\lambda$), allowing effective emission of electrons from sidewalls with a low emission barrier height. For example, since the electron mean free path $\lambda$ in CVD diamond, which are unintentionally doped with impurity atoms, is approximately one to ten micrometers (D. Kania et al., "Diamond and Related Materials" Vol. 2, p. 1012, (1993)), the width W of the wide bandgap semiconductor pillars $R_{i-1,j-2}$, $R_{i-1,j-1}$, $R_{i-1,j}$, and $R_{i-1,j+1}, \ldots$ may be approximately $2\lambda$=two to twenty micrometers. More generally, the "width W" is defined to be a mean width $W_{mean}$ measured at the top end faces. If the two dimensional shape of the top end faces of the semiconductor pillars $R_{i-1,j-2}$, $R_{i-1,j-1}$, $R_{i-1,j}$, and $R_{i-1,j+1}, \ldots$ is square, the width W is the length of a side of the square. If the two dimensional shape of the top end faces is rectangle, the width W is an average of long side length "a" and short side length "b":

$$W_{mean}=(a+b)/2 \tag{2}$$

In other words, "the width $W_{mean}$" is defined by an average of the distances between opposite sides, in the two dimensional shape of the top end faces of the wide bandgap semiconductor pillars $R_{i-1,j-2}$, $R_{i-1,j-1}$, $R_{i-1,j}$, and $R_{i-1,j+1}$. The opposite sides are defined to be opposite edges of the top end faces of the wide bandgap semiconductor pillars $R_{i-1,j-2}$, $R_{i-1,j-1}$, $R_{i-1,j}$, and $R_{i-1,j+1}$, the plane of the top end face intersects with the planes of sidewalls at respective edges of the top end faces.

Assuming the length of the long axis as "a" and the length of the short axis as "b", for a case where the two dimensional shape of the top end faces of the wide bandgap semiconductor pillars $R_{i-1,j-2}$, $R_{i-1,j-1}$, $R_{i-1,j}$, and $R_{i-1,j+1}, \ldots$ is ellipse, $W_{mean}$ is defined by Equation (2). If the two dimensional shape of the top end faces of the wide bandgap semiconductor pillars $R_{i-1,j-2}$, $R_{i-1,j-1}$, $R_{i-1,j}$, and $R_{i-1,j+1}, \ldots$ is perfect circle, $W_{mean}$ is the diameter of the perfect circle. If the two dimensional shape of the top end faces of the wide bandgap semiconductor pillars $R_{i-1,j-2}$, $R_{i-1,j-1}$, $R_{i-1,j}$, and $R_{i-1,j+1}, \ldots$ is hexagon, $W_{mean}$ is an average of three distances $w_1$, $w_2$, and $w_3$ between respective sides facing each other, namely an average of distances $w_1$, $w_2$, and $w_3$ between three sets of opposite sides is given by:

$$W_{mean}=(w_1+w_2+w_3)/3 \tag{3}$$

More generally, if there are n distances (line segments) $w_1$, $w_2$, $w_3, \ldots, w_n$ between respective opposite sides, in the two dimensional shape of the top end faces of the wide bandgap semiconductor pillars $R_{i-1,j-2}$, $R_{i-1,j-1}$, $R_{i-1,j}$, and $R_{i-1,j+1}$, an average of n distances (line segments) is defined by:

$$W_{mean}=(w_1+w_2+w_3+\ldots+w_n)/n \tag{4}$$

The n distances (line segments) $w_1$, $w_2$, $w_3, \ldots, w_n$ between opposite sides are defined to be the respective distances between opposite edges of the top end faces of the wide bandgap semiconductor pillars $R_{1-1,j-2}$, $R_{i-1,j-1}$, $R_{i-1,j}$, and $R_{i-1,j+1}, \ldots$, the plane of the top end face intersects with 2n planes of sidewalls at respective edges of the top end faces.

Note that in a theoretical consideration, a certain effectiveness of electron emission can be expected if the minimum value of the n distances (line segments) $w_1$, $w_2$, $w_3, \ldots, w_n$ is not larger than twice the electron mean free path $\lambda$ in the wide bandgap semiconductor; however, considering the electron emission efficiency, it is preferable that the mean width $W_{mean}$, which is measured at the top end faces of the wide bandgap semiconductor pillars $R_{i-1,j-2}$, $R_{i-1,j-1}$, $R_{i-1,j}$, and $R_{i-1,j+1}, \ldots$, is not larger than twice the electron mean free path $\lambda$ in the wide bandgap semiconductor.

There is an example where the mean free path $\lambda$ of diamond electrons is approximately one to ten micrometers even through a speculation based upon a measurement of a UV sensor, measuring the change in photoconduction due to ultraviolet excitation. However, since the mean free path $\lambda$ is affected by grain boundaries, use of crystals having grain boundaries sufficiently larger than the mean free path $\lambda$ is required.

Mean free path $\lambda$ of carriers depends on mobility $\mu$ of the carriers in the wide bandgap semiconductor. For example, assuming $\mu_n$ denotes mobility of electrons, q denotes elementary charge, k denotes the Boltzmann constant, T denotes absolute temperature, and m* denotes electron effective mass, electron mean free path $\lambda$ is represented by:

$$\lambda=(\mu_n/q)(3kTm^*)1/2 \tag{5}$$

The fact that the mean free path $\lambda$ of carriers being dependant on mobility $\mu$ of the carriers signifies that the mean free path $\lambda$ of carriers is dependant on crystallographic quality of the wide bandgap semiconductor and impurity concentration of the carriers. For a high impurity concentration of at least $10^{17}$ $cm^{-3}$, the electron mean free path $\lambda$ in diamond may be one micrometer or less. Therefore, for example, assuming mean free path $\lambda$ of the wide bandgap semiconductor to be approximately 100 nm, the width W of the wide bandgap semiconductor pillars $R_{i-1,j-2}$, $R_{i-1,j-1}$, $R_{i-1,j}$, and $R_{i-1,j+1}$, . . . is preferably formed to be approximately 2λ=200 nm or less.

In any case, if an NEA sidewall exists within a distance in which electrons excited through the Auger transition process remain and drift in a conduction band, probability of electron emission increases, thereby the width W of the wide bandgap semiconductor pillars $R_{i-1,j-2}$, $R_{i-1,j-1}$, $R_{i-1,j}$, and $R_{i-1,j+1}$, . . . may be not larger than approximately 2λ. Note that even if the cross-sectional views of the semiconductor pillars $R_{i-1,j-2}$, $R_{i-1,j-1}$, $R_{i-1,j}$, and $R_{i-1,j+1}$, . . . are inverse tapered shaped, "the width W" is defined as "mean width $W_{mean}$ measured at top end face", and thus the mean width $W_{mean}$ near the top end faces is important. In an inverse tapered shape in a cross-sectional view, the width at a location deeper from the top end faces than the electron mean free path λ is narrower than the mean width $W_{mean}$ defined near the top end faces. However, since efficiency of electron excitation through the Auger transition process decreases at a location deeper from the top end faces than the electron mean free path λ, the effectiveness of the width at a deeper location becomes not significant against the electron emission as a whole.

In addition, the wide bandgap semiconductors implementing the wide bandgap semiconductor pillars $R_{i-1,j-2}$, $R_{i-1,j-1}$, $R_{i-1,j}$, $R_{i-1,j+1}$, . . . are preferably single crystals. However, if the wide bandgap semiconductors are polycrystals, it is preferable to make an average grain diameter to be larger than the width W of the wide bandgap semiconductor pillars $R_{i-1,j-2}$, $R_{i-1,j-1}$, $R_{i-1,j}$, $R_{i-1,j+1}$, . . . .

As such, according to the first discharge electrode of the first embodiment of the present invention, a cathode voltage drop can be considerably reduced compared to the earlier metallic cathode by utilizing the highly efficient secondary-electron emission from the hydrogen terminated surfaces on the wide bandgap semiconductors, which are assembled in a discharge lamp.

The shape of the wide bandgap semiconductor pillars $R_{i-1,j-2}$, $R_{i-1,j-1}$, $R_{i-1,j}$, and $R_{i-1,j+1}$, . . . , $R_{i,j-2}$, $R_{i,j-1}$, $R_{i,j}$, $R_{i,j+1}$, . . . , which are used for the electron-emitting layer 2*a* of the first discharge electrode (2*a*, 1*a*, 11*a*, 12*a*), according to the first embodiment of the present invention, may take various shapes such as a cylindrical shape or the like. When the wide bandgap semiconductor pillars $R_{i-1,j-2}$, $R_{i-1,j-1}$, $R_{i-1,j}$, and $R_{i-1,j+1}$, . . . , $R_{i,j-2}$, $R_{i,j-1}$, $R_{i,j}$, $R_{i,j+1}$, . . . are miniaturized to have diameters of approximately 2λ=200 nm or less, a cylindrical shape is easier to fabricate.

A fabrication method for the electron-emitting layer 2*a* of the first discharge electrode, according to the first embodiment of the present invention, is described with reference to FIGS. 5A to 5E. Note that the fabrication method for the electron-emitting layer 2*a* including cylindrical wide bandgap semiconductor pillars $R_{i,j-1}$, $R_{i,j}$, $R_{i,j+1}$, $R_{i,j+2}$, . . . described forthwith is merely an example, and the present invention may naturally be implemented using other various fabrication methods including the modification.

Figure 5A:
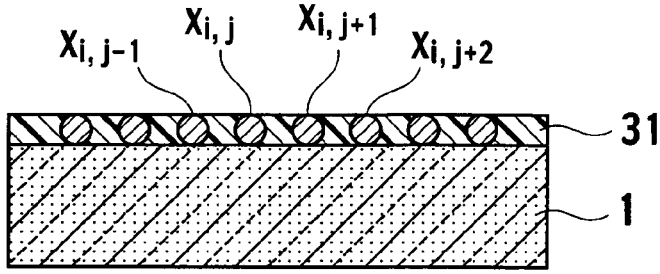
FIG. 5A is a process flow cross sectional view showing an intermediate product of the electron-emitting layer of the first discharge electrode according to the first embodiment of the present invention, which corresponds to a cross section taken on line III-III in FIG. 2B, explaining a manufacturing method of the first discharge electrode according to the first embodiment.
Figure 5B:
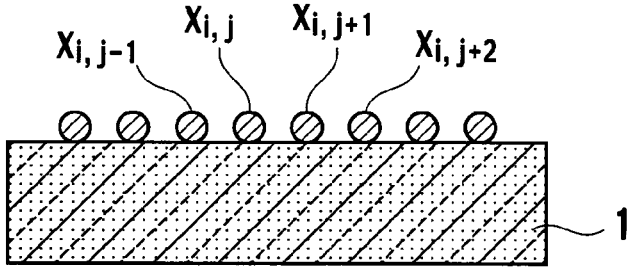
FIG. 5B is a subsequent process flow cross sectional view showing the intermediate product of the electron-emitting layer of the first discharge electrode according to the first embodiment after the process stage shown in FIG. 5A.

(a) To begin with, as shown in FIG. 5A, liquid suspension resin 31 including grains $X_{i,j-1}$, $X_{i,j}$, $X_{i,j+1}$, $X_{i,j+2}$, . . . with substantially uniform diameters of approximately 2λ=200 nm is applied to the top surface of a wide bandgap semiconductor substrate 1. The liquid suspension resin 31 is evaporated (dried), and as shown in FIG. 5B, the remaining grains $X_{i,j-1}$, $X_{i,j}$, $X_{i,j+1}$, $X_{i,j+2}$, . . . are then adhered to the surface of the wide bandgap semiconductor substrate 1. As a result, the grains $X_{i,j-1}$, $X_{i,j}$, $X_{i,j+1}$, $X_{i,j+2}$, . . . are arranged at nearly constant intervals as an etching mask on the surface of the wide bandgap semiconductor substrate 1.

Figure 5C:
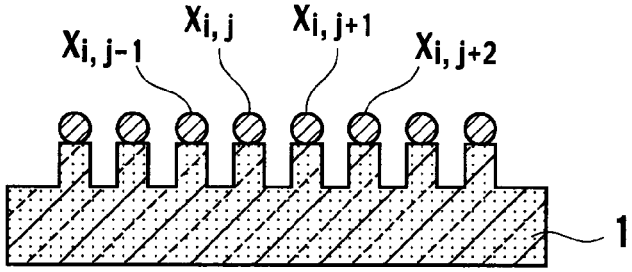
FIG. 5C is a subsequent process flow cross sectional view showing the intermediate product of the electron-emitting layer of the first discharge electrode according to the first embodiment, after the process stage shown in FIG. 5B.

(b) The wide bandgap semiconductor substrate 1 having the grains $X_{i,j-1}$, $X_{i,j}$, $X_{i,j+1}$, $X_{i,j+2}$, . . . on the top surface is brought into an etching chamber, and the etching chamber is then evacuated. As shown in FIG. 5C, the surface of the wide bandgap semiconductor substrate 1 is selectively etched and removed through reactive ion etching (RIE) or the like using the grains $X_{i,j-1}$, $X_{i,j}$, $X_{i,j+1}$, $X_{i,j+2}$, . . . as an etching mask. For example, if the wide bandgap semiconductor is a diamond, RIE may be carried out using a mixed gas of tetrafluoromethane ($CF_4$) plus a trace of oxygen ($O_2$) Intermittently adding oxygen to $CF_4$ gas is effective in RIE of a diamond. In the intermittent-oxygen-added RIE, a layer of a fluoro-carbon (CF) based polymer is formed on sidewalls at the time of the etching with $CF_4$ gas without adding any oxygen, while the bottom of the groove is etched so as to leave the CF based polymer layer at sidewall of the groove at the time of etching with the mixed gas of $CF_4$ plus $O_2$, as a whole, resulting in pillar shapes or pore structures, establishing a high aspect ratio of the cross sectional view of the pillar or the pore.

Figure 5D:
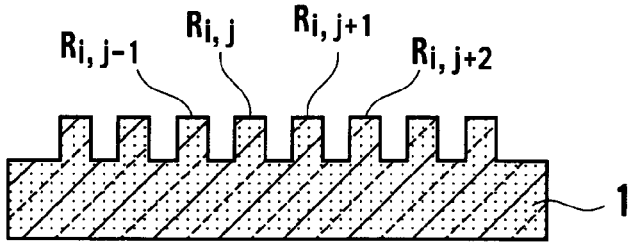
FIG. 5D is a further subsequent process flow cross sectional view showing the intermediate product of the electron-emitting layer of the first discharge electrode according to the first embodiment after the process stage shown in FIG. 5C.

(c) Next, by removing the grains $X_{i,j-1}$, $X_{i,j}$, $X_{i,j+1}$, $X_{i,j+2}$, . . . from the surface of the wide bandgap semiconductor substrate 1, cylindrical wide bandgap semiconductor pillars $R_{i,j-1}$, $R_{i,j}$, $R_{i,j+1}$, $R_{i,j+2}$, . . . with diameters of approximately 2λ=200 nm are formed on the surface of the wide bandgap semiconductor substrate 1 as shown in FIG. 5D.

Figure 5E:
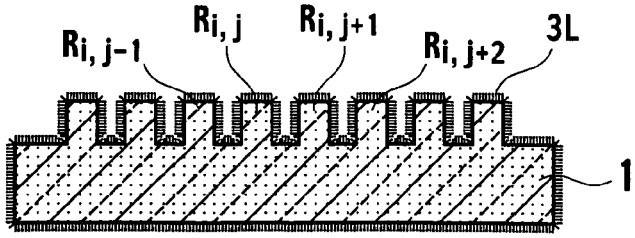
FIG. 5E is a still further subsequent process flow cross sectional view showing the electron-emitting layer of the first discharge electrode according to the first embodiment after the process stage shown in FIG. 5D.

(d) Subsequently, the etching chamber is vacuum evacuated. Hydrogen gas is introduced into the etching chamber, and the entire surface of the wide bandgap semiconductor substrate 1 is subjected to ambient of the hydrogen plasma processing. Through hydrogen plasma processing, as shown in FIG. 5E, a hydrogen adsorbed layer 3L is formed on the surfaces of the wide bandgap semiconductor pillars $R_{i,j-1}$, $R_{i,j}$, $R_{i,j+1}$, $R_{i,j+2}$, . . . including top end faces and sidewalls, and dangling bonds at the surfaces of the wide bandgap semiconductor pillars $R_{i,j-1}$, $R_{i,j}$, $R_{i,j+1}$, $R_{i,j+2}$, . . . are terminated with bonds of hydrogen atoms 3.

Note that the step of terminating the dangling bonds at the surfaces of the wide bandgap semiconductor pillars $R_{i,j-1}$, $R_{i,j}$, $R_{i,j+1}$, $R_{i,j+2}$, . . . with atomic hydrogen 3 may be carried out just before or as part of a step of integrating the first discharge electrode in a sealed-off tube 9, which implements a discharge lamp. In other words, the product of the first discharge electrode can be shipped either in a form in which the dangling bonds at the surfaces of the wide bandgap semiconductor pillars $R_{i,j-1}$, $R_{i,j}$, $R_{i,j+1}$, $R_{i,j+2}$, . . . are terminated by bonds of hydrogen atoms 3, or in a form in which the dangling bonds are not terminated by the bonds of hydrogen atoms 3.

Furthermore, in a case where the width W of the wide bandgap semiconductor pillars $R_{i-1,j-2}$, $R_{i-1,j-1}$, $R_{i-1,j}$, $R_{i-1,j+1}$, . . . is relatively wide, for example, the width W is approximately two to twenty micrometers, the wide bandgap semiconductor pillars $R_{i-1,j-2}$, $R_{i-1,j-1}$, $R_{i-1,j}$, $R_{i-1,j+1}$, . . . may be formed by coating a photoresist on the wide bandgap semiconductor substrate 1, delineating the photoresist through photolithography so that a pattern of photoresist 32 can remain selectively on the scheduled top end faces of the wide bandgap semiconductor pillars $R_{i-1,j-2}$, $R_{i-1,j-1}$, $R_{i-1,j}$, and $R_{i-1,j+1}$, . . . , and subjecting the surface of the wide bandgap semiconductor substrate 1 to selective etching and removing, as shown in FIG. 5C, through RIE using the delineated photoresist as an etching mask.

First Modification of the First Embodiment

Figure 6:
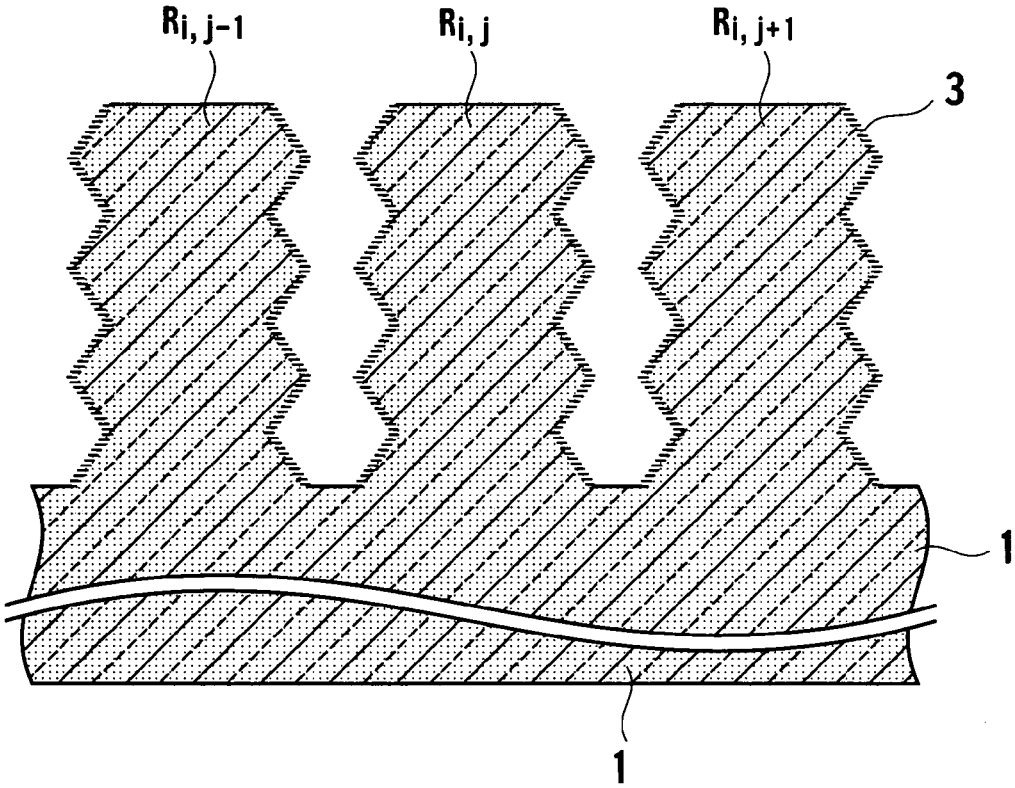
FIG. 6 is a cross-sectional view illustrating part of an electron-emitting layer of a first discharge electrode, according to a modification (a first modification) of the first embodiment of the present invention.

As shown in FIG. 6, each of the wide bandgap semiconductor pillars $R_{i,j-1}$, $R_{i,j}$, $R_{i,j+1}$, . . . according to a modification (first modification) of the first embodiment has sidewalls with irregular shapes instead of being straight plane as shown in FIG. 3. Each of the sidewalls is provided with a plurality of overhangs projecting from the sidewalls. The lower surfaces of the overhangs are "hidden surfaces" or surfaces unseen from above the primary surfaces (top end faces) of the wide bandgap semiconductor pillars $R_{i,j-1}$, $R_{i,j}$, $R_{i,j+1}$, . . . . Randomly shaped sidewalls having such hidden surfaces and a top end face define each of the protrusions implementing the wide bandgap semiconductor pillars $R_{i,j-1}$, $R_{i,j}$, $R_{i,j+1}$, . . . . As shown in FIG. 6, since dangling bonds on the lower surfaces (hidden surfaces) of the overhangs projecting from the sidewalls are shaded from electric fields near the first discharge electrode primary surface, which is subjected to hydrogen-termination treatment, the probability of noble-gas-ion-bombarded hydrogen-desorption may be reduced more than the probability on the flat sidewalls (vertical sidewalls) parallel to the direction of ion movement vectors shown in FIG. 3. As a result, the electron-emitting layer 2*a* is capable of maintaining a highly efficient NEA surface with a longer lifetime than with the vertical sidewalls.

For example, if the wide bandgap semiconductor is diamond, irregular shaped sidewalls having overhangs as shown in FIG. 6 may be formed by carrying out RIE intermittently using a mixed gas of $CF_4$ plus a trace of $O_2$. As described above, since CF polymer layer is formed on sidewalls without any oxygen and the bottom is etched at the time of adding oxygen during RIE of diamond, roughness of the etched sidewalls may be changed by changing the intermittent cycle.

Second Modification of the First Embodiment

Figure 7:
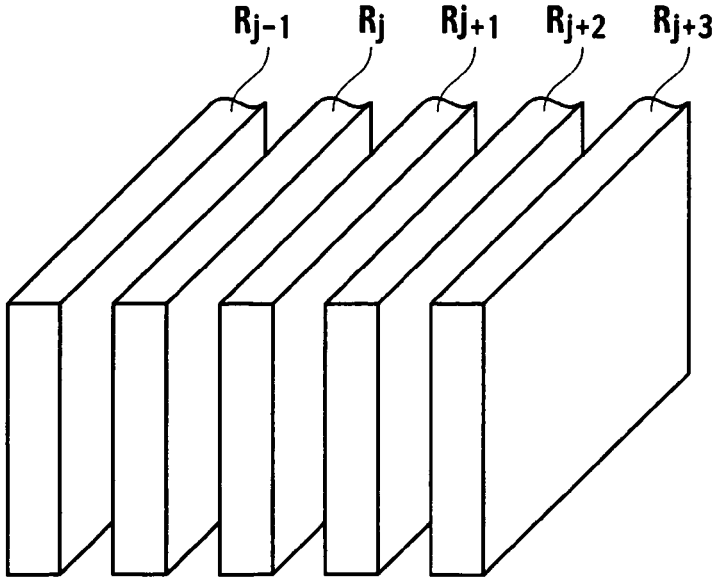
FIG. 7 is a fragmentary bird's eye view illustrating part of an electron-emitting layer of a first discharge electrode, according to another modification (a second modification) of the first embodiment of the present invention.

FIG. 7 shows part of the electron-emitting layer of the first discharge electrode according another modification (second modification) of the first embodiment, where parallel walls, or parallel tabular ridges $R_{j-1}$, $R_j$, $R_{j+1}$, . . . separated by narrow grooves are provided instead of the wide bandgap semiconductor pillars $R_{i-1,j-2}$, $R_{i-1,j-1}$, $R_{i-1,j}$, and $R_{i-1,j+1}$, . . . . shown in FIGS. 2A, 2B, and 3. In the electron-emitting layer 2*a* implemented by the parallel tabular ridges $R_{j-1}$, $R_j$, $R_{j+1}$, . . . shown in FIG. 7, since the dangling bonds on the surfaces of the sidewalls (vertical sidewalls) that are always parallel to the electric fields perpendicular to the primary surfaces of the first discharge electrode are subjected to hydrogen-termination treatment, the probability of noble-gas-ion-bombarded hydrogen-desorption is reduced even if hydrogen desorbs from the top end faces of the ridges $R_{j-1}$, $R_j$, $R_{j+1}$, . . . . As a result, the electron-emitting layer 2*a* is capable of maintaining a highly efficient NEA surface with a long lifetime. Furthermore, by selecting the thickness of the tabular ridges $R_{j-1}$, $R_j$, $R_{j+1}$, . . . to a value not larger than double the electron mean free path $\lambda$, the NEA surface can be located near the region where ion bombardment occurs. Such selection of the thickness of the tabular ridges $R_{j-1}$, $R_j$, $R_{j+1}$, can facilitate a high efficient emission of excited electrons, which are generated in the wide bandgap semiconductor, to the outside of the electron-emitting layer 2*a*.

According to the second modification of the first embodiment of the present invention, by providing the ridges $R_{j-1}$, $R_j$, $R_{j+1}$, . . . shown in FIG. 7, reliable cathode characteristics is achieved without reducing electron emission efficiency, and the cathode voltage drop can be considerably reduced compared to the earlier metallic cathode, utilizing the highly efficient secondary-electron emission from the area of hydrogen terminated dangling bonds at the surface of the wide bandgap semiconductor.

Third Modification of the First Embodiment

Figure 8:
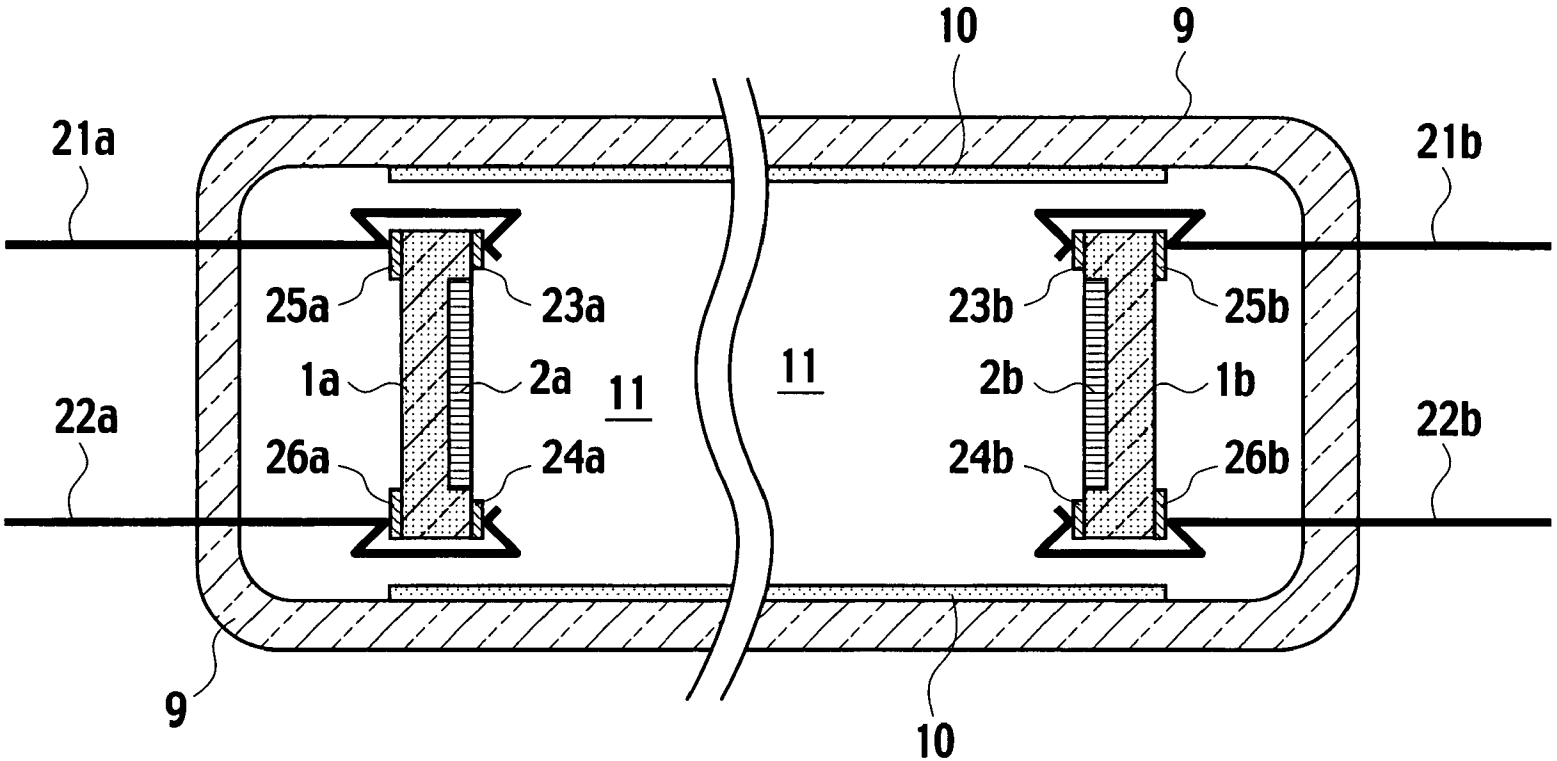
FIG. 8 is a cross-sectional view illustrating an illuminative lamp, according to a still another modification (a third modification) of the first embodiment of the present invention.

As shown in FIG. 8, a discharge lamp according to a still another modification (third modification) of the first embodiment of the present invention encompasses a sealed-off tube 9 filled in with a discharge gas 11, and a first discharge electrode (1*a*, 2*a*, 23*a*, 24*a*, 25*a*, 26*a*) and a second discharge electrode (1*b*, 2*b*, 23*b*, 24*b*, 25*b*, 26*b*), which are provided in the inside of the sealed-off tube 9 on either side. Of the pair of discharge electrodes, the first discharge electrode (1*a*, 2*a*, 23*a*, 24*a*, 25*a*, 26*a*) on the left side of FIG. 8 embraces a wide bandgap semiconductor (wide gap semiconductor) substrate 1*a* as a "supporting base", and an electron-emitting layer 2*a* as an emitter formed on the surface of the wide bandgap semiconductor substrate (supporting base) 1*a*. In addition, top contact films 23*a* and 24*a*, which make ohmic contact with the wide bandgap semiconductor substrate 1*a* with low contact resistance, are selectively formed on the surface of the wide bandgap semiconductor substrate (emitter) 1*a*. Although the illustration is omitted, amorphous contact regions are formed in respective areas near the surface of the wide bandgap semiconductor substrate 1*a* just below the top contact films 23*a* and 24*a*. Similarly, bottom contact films 25*a* and 26*a*, which make ohmic contact with the wide bandgap semiconductor substrate 1*a* with low contact resistance, are selectively formed on the bottom surface of the wide bandgap semiconductor substrate (emitter) 1*a*. Amorphous contact regions are formed in respective areas near the bottom surface of the wide bandgap semiconductor substrate 1*a* just below the bottom contact films 25*a* and 26*a*. Stem leads 21*a* and 22*a* are electrically connected to the wide bandgap semiconductor substrate 1*a* via the top contact films 23*a* and 24*a* on the top surface and the bottom contact films 25*a* and 26*a* on the bottom surface. Each of the tips of the respective stem leads 21*a* and 22*a* establish a spring structure with a plurality of acutely-angled (or nearly right-angled) bent portions. Although the tips of the stem leads 21*a* and 22*a* are made of a material such as tungsten (W), molybdenum (Mo) or the like, so as to implement the spring structure, but the metal-to-glass seal of the sealed-off tube 9 may use Kovar or Fe54%—Ni29%—Co17% alloy.

The stem leads 21*a* and 22*a* have respective bent-corner portions touching the bottom contact films 25*a* and 26*a* on the bottom surface of the wide bandgap semiconductor substrate 1*a* that are opposite the top contact films 23*a* and 24*a*, and tightly hold the wide bandgap semiconductor substrate 1*a* from both sides like springs. The stem leads 21*a* and 22*a* serve as cathode terminals for supplying current to the emitter (electron-emitting layer) 2*a* implemented by the wide bandgap semiconductor substrate 1*a*.

The second discharge electrode (1*b*, 2*b*, 23*b*, 24*b*, 25*b*, 26*b*) on the right side of FIG. 8 encompasses a wide bandgap semiconductor (wide gap semiconductor) substrate 1*b* as a supporting base, and an electron-emitting layer 2*b* as an emitter formed on the surface of the wide bandgap semiconductor substrate 1*b*. In addition, top contact films 23*b* and 24*b*, which make ohmic contact with the wide bandgap semiconductor substrate (supporting base) 1*b*, are selectively formed on the surface of the wide bandgap semiconductor substrate (emitter) 1*b*. Similarly, bottom contact films 25*b* and 26*b*, which make ohmic contact with the wide bandgap semiconductor substrate 1*b* with low contact resistance, are selectively formed on the bottom surface of the wide bandgap semiconductor substrate (emitter) 1*b*. Amorphous contact regions (the illustration is omitted) are respectively formed in areas near the surface of the wide bandgap semiconductor substrate 1*b* just below the top contact films 23*b* and 24*b*, and amorphous contact regions are respectively formed in areas near the bottom surface of the wide bandgap semiconductor substrate 1*b* just below the bottom contact films 25*b* and 26*b*. In the manner, the top contact films 23*b* and 24*b* on the top surface and the bottom contact films 25*b* and 26*b* on the bottom surface respectively make ohmic contact with the wide bandgap semiconductor substrate 1*b* with low contact resistance. Stem leads 21*b* and 22*b* are electrically connected to the wide bandgap semiconductor substrate 1*b* via the top contact films 23*b* and 24*b* on the top surface and the bottom contact films 25*b* and 26*b* on the bottom surface. The stem leads 21*b* and 22*b* have respective bent-corner portions touching the bottom contact films 25*b* and 26*b* on the bottom surface of the wide bandgap semiconductor substrate 1*b* that are opposite the top contact films 23*b* and 24*b*, and tightly hold the wide bandgap semiconductor substrate 1*b* from both sides like springs. The stem leads 21*b* and 22*b* serve as anode terminals.

The electron-emitting layer 2*a* of the first discharge electrode (1*a*, 2*a*, 23*a*, 24*a*, 25*a*, 26*a*) of the discharge lamp, according to the third modification of the first embodiment shown in FIG. 8, also encompasses wide bandgap semiconductor pillars $R_{i-1,j-2}$, $R_{i-1,j-1}$, $R_{i-1,j}$, $R_{i-1,j+1}$, . . . , $R_{i,j-2}$, $R_{i,j-1}$, $R_{i,j}$, $R_{i,j+1}$, . . . as shown in FIGS. 2 and 3. As a result, in the hydrogen terminated structure of the dangling bonds at the surfaces of the wide bandgap semiconductors, even if hydrogen desorbs from the primary surfaces (top end faces) of the wide bandgap semiconductor pillars $R_{i-1,j-2}$, $R_{i-1,j-1}$, $R_{i-1,j}$, $R_{i-1,j+1}$, . . . , $R_{i,j-2}$, $R_{i,j-1}$, $R_{i,j+1}$, . . . , a highly efficient NEA surface with a long lifetime may be maintained by providing a sidewall structure, in which the sidewalls of the wide bandgap semiconductor pillars $R_{i-1,j-2}$, $R_{i-1,j-1}$, $R_{i-1,j}$, $R_{i-1,j+1}$, . . . , $R_{i,j-2}$, $R_{i,j-1}$, $R_{i,j}$, $R_{i,j+1}$, . . . are configured to be always parallel to the electric fields perpendicular to the primary surfaces of the first discharge electrode, because the sidewalls of the wide bandgap semiconductor pillars $R_{i-1,j-2}$, $R_{i-1,j-1}$, $R_{i-1,j}$, $R_{i-1,j+1}$, . . . , $R_{i,j-2}$, $R_{i,j-1}$, $R_{i,j}$, $R_{i,j+1}$, . . . are not easily bombarded with noble gas ions accelerated by the electric fields, after terminating the dangling bonds on the surfaces of the sidewalls (vertical sidewalls) with bonds of atomic hydrogen. Furthermore, provision of the NEA surfaces of the wide bandgap semiconductor pillars $R_{i-1,j-2}$, $R_{i-1,j-1}$, $R_{i-1,j}$, $R_{i-1,j+1}$, . . . , $R_{i,j-2}$, $R_{i,j-1}$, $R_{i,j}$, $R_{i,j+1}$, . . . in the vicinity of the region where ion bombardment occurs can achieve a highly efficient emission of excited electrons, which are generated in the wide bandgap semiconductor, to the outside of the electron-emitting layer 2*a*. Accordingly, reliable cathode characteristics are provided without reducing electron emission efficiency. In other words, a cathode voltage drop can be considerably reduced compared to the earlier metallic cathode by utilizing the highly efficient secondary-electron emission from the hydrogen terminated surfaces on the wide bandgap semiconductors.

Second Embodiment

Figure 9:
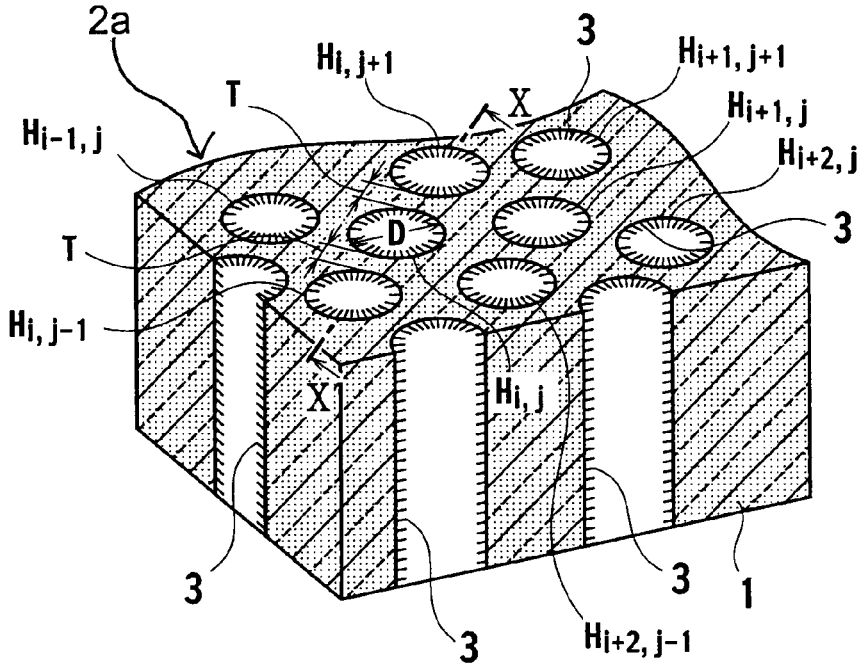
FIG. 9 is a fragmentary bird's eye view illustrating part of an electron-emitting layer of a first discharge electrode, according to a second embodiment of the present invention.

FIG. 9 is a fragmentary bird's eye view illustrating part of an electron-emitting layer 2*a* provided in a first discharge electrode of a discharge lamp, according to a second embodiment of the present invention, in which a part corresponding to portion A of FIG. 1 is enlarged. In the first discharge electrode of the discharge lamp, according to the second embodiment, a cathode base plate implemented by a wide bandgap semiconductor substrate 1 made of diamonds, for example, has a plurality of fine pores $H_{i-1,j}$, . . . , $H_{i,j}$, . . . , $H_{i+2,j}$, . . . , which have sidewalls (vertical sidewalls) roughly parallel to electric fields perpendicular to the primary surfaces of the first discharge electrode. Dangling bonds on the surfaces of respective sidewalls (vertical sidewalls) of the fine pores $H_{i-1,j}$, . . . , $H_{i,j}$, . . . , $H_{i+2,j}$, . . . are subjected to hydrogen-termination treatment. Since the rest of the configuration of the discharge lamp is effectively the same as that of the discharge lamp according to the first embodiment shown in FIG. 1, repetitive description thereof is omitted.

By adopting the configuration of the electron-emitting layer 2*a* shown in FIG. 9, even if the hydrogen-terminated surface of dangling bonds on the primary surfaces (top end faces) of the electron-emitting layer 2*a* in the first discharge electrode is bombarded by noble gas ions accelerated by the electric field, which is established between the first discharge electrode electrodes (2*a*, 1*a*, 11*a*, 12*a*) and the second discharge electrode electrodes (2*b*, 1*b*, 11*b*, 12*b*) as shown in FIG. 1, since hydrogen-terminated surfaces of the sidewalls (vertical sidewalls) of the fine pores $H_{i-1,j}$, . . . , $H_{i,j}$, . . . , $H_{i+2,j}$, . . . , which are not easily bombarded with the noble gas ions, the hydrogen-terminated structure remains to the dangling bonds at the sidewalls, secondary-electron emission from the sidewalls of the fine pores $H_{i-1,j}$, . . . , $H_{i,j}$, . . . , $H_{i+2,j}$, . . . is maintained, preventing reduction in electron emission efficiency as a whole.

Figure 10:
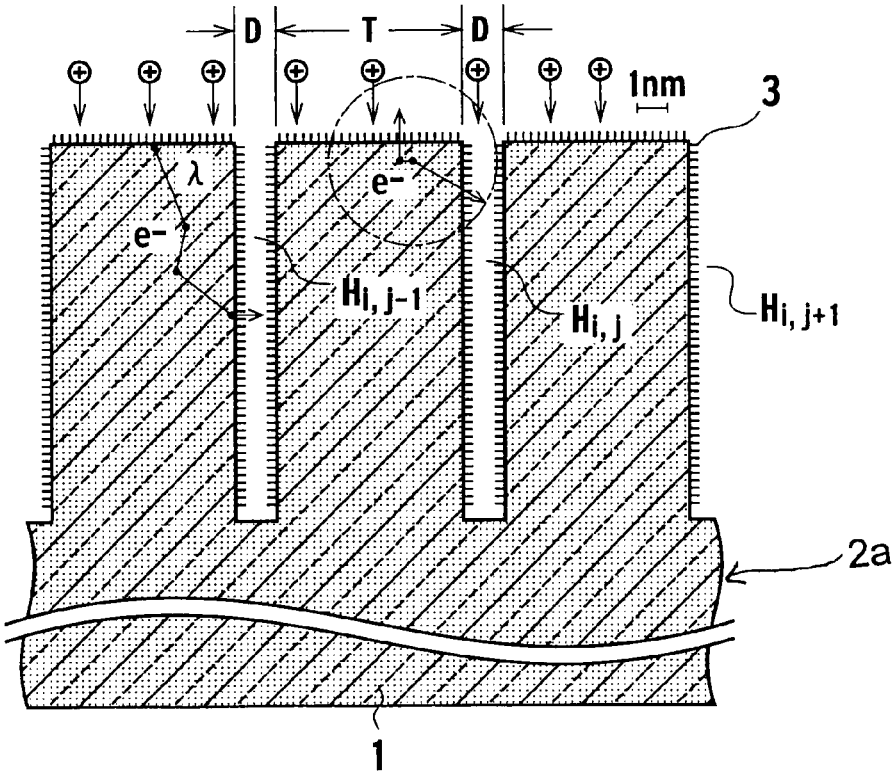
FIG. 10 is a cross-sectional view taken on line X-X in FIG. 9.

FIG. 10 is a cross-sectional view taken on line X-X in FIG. 9. A sidewall of the fine pore $H_{i-1,j}$ and a sidewall of the fine pore $H_{i,j}$ define a geometry of a central protrusion having a top end face and sidewalls in the cross-sectional view shown in FIG. 10. At least part of the surface of the central protrusion is unseen from a perpendicular direction to a top surface of the electron-emitting layer 2*a* above the top surface of the electron-emitting layer 2*a*. Another sidewall of the fine pore $H_{i,j}$ and a sidewall of the fine pore $H_{i,j+1}$ define a geometry of a right side protrusion having a top end face and sidewalls in the cross-sectional view shown in FIG. 10. At least part of the surface of the right side protrusion is unseen from a perpendicular direction to the top surface of the electron-emitting layer 2*a* above the top surface of the electron-emitting layer 2*a*. Although the central protrusion and the right side protrusion are illustrated as if to be separated in the cross-sectional view in FIG. 10, the central protrusion and the right side protrusion are actually merged into a single piece in a plan view as understood by the bird's eye view shown in FIG. 9, the central protrusion and the right side protrusion are connected at near side and rear side of the paper showing the cross-sectional view. Similarly a left side protrusion and the central protrusion are connected at near side and rear side of the paper showing the cross-sectional view. Diameter of respective fine pores $H_{i-,j}$, . . . , $H_{i,j}$, . . . , $H_{i+2,j}$, . . . is D, and the fine pores $H_{i-1,j}$, . . . , $H_{i,j}$, . . . , $H_{i+2,j}$, . . . are respectively separated by distance T. Selection of distance T between the respective fine pores $H_{i-1,j}$, . . . , $H_{i,j}$, . . . , $H_{i+2,j}$, . . . so that electrons, which are generated by the ion-bombardment to the top end face of the wide bandgap semiconductor substrate 1 or the primary surface of the electron-emitting layer 2*a* of the first discharge electrode, can reach the sidewalls within an electron movable distance within a crystal (i.e., electron mean free path $\lambda$) allows efficient emission of electrons from sidewalls with a low emission barrier height. For example, distance T may be selected so that a radius of an inscribed circles to three extremely closely positioned fine pores $H_{i,j}$, $H_{i,j+1}$, and $H_{i+1,j}$ is approximately not larger than the mean free path $\lambda$ of the generated electrons. As described with the first embodiment, since the mean free path $\lambda$ of general electrons in a wide bandgap semiconductor is approximately one to ten micrometers, distance T is preferably selected so that respective inscribed circles to extremely closely positioned three fine pores is not larger than approximately one to ten micrometers.

As shown in FIG. 9, according to the first discharge electrode of the second embodiment of the present invention, which is configured to be assembled in a discharge lamp, dangling bonds on surfaces of sidewalls parallel to electric fields perpendicular to the primary surfaces of the first discharge electrode is subjected to hydrogen-termination treatment. Therefore, the probability of noble-gas-ion-bombarded hydrogen-desorption is reduced. As a result, the electron-emitting layer 2*a*, according to the second embodiment, is capable of maintaining a highly efficient NEA surface with a long lifetime.

A fabrication method for the electron-emitting layer 2*a* of the first discharge electrode, according to the second embodiment of the present invention, is described with reference to FIGS. 11A to 11D. Note that the fabrication method for the electron-emitting layer 2*a* described forthwith is merely an example, and the present invention may naturally be implemented using other various fabrication methods including the modification.

Figure 11A:
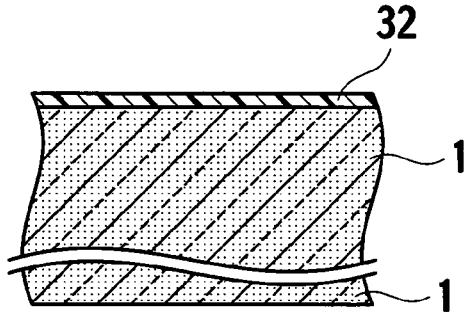
FIG. 11A is a process flow cross sectional view showing an intermediate product of the electron-emitting layer of the first discharge electrode according to the second embodiment of the present invention, which corresponds to a cross section taken on line X-X in FIG. 9, explaining a manufacturing method of the first discharge electrode according to the second embodiment.

(a) To begin with, as shown in FIG. 11A, a photoresist 32 is coated so as to form a mask layer on a wide bandgap semiconductor substrate 1. The photoresist 32 is then delineated by photolithography to selectively remove the photoresist 32 at places where fine pores are intended to be formed.

Figure 11B:
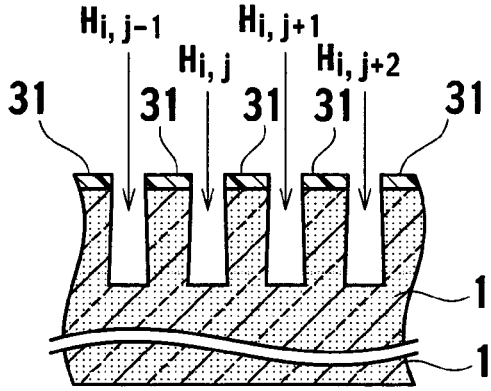
FIG. 11B is a subsequent process flow cross sectional view showing the intermediate product of the electron-emitting layer of the first discharge electrode according to the second embodiment after the process stage shown in FIG. 11A.

(b) The wide bandgap semiconductor substrate 1 having the delineated photoresist 32 on the top surface is brought into an etching chamber, and the etching chamber is then vacuum evacuated. As shown in FIG. 11B, the surface of the wide bandgap semiconductor substrate 1 is selectively etched and removed through RIE or the like using the delineated photoresist 32 as an etching mask to form fine pores $H_{i-1,j}, \ldots, H_{i,j}, \ldots, H_{i+2,j}, \ldots$.

Figure 11C:
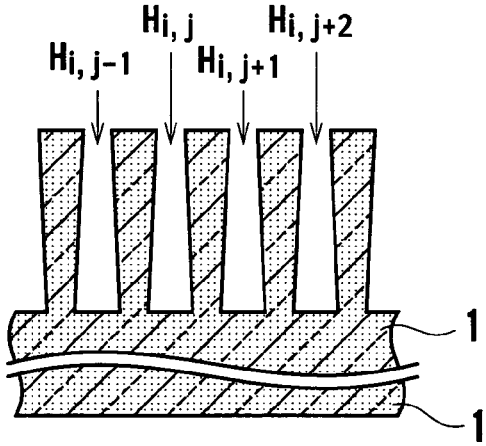
FIG. 11C is a subsequent process flow cross sectional view showing the intermediate product of the electron-emitting layer of the first discharge electrode according to the second embodiment, after the process stage shown in FIG. 11B.

(c) In addition, the etching gas pressure for RIE is increased while the power for RF discharge is reduced, bringing the interior of the etching chamber to have an appropriate conditions for chemical dry etching (CDE), so as to form inverse tapered shaped fine pores $H_{i-,j}, \ldots, H_{i,j}, \ldots, H_{i+2,j}, \ldots$, in which the diameter of fine pores $H_{i-1,j}, \ldots, H_{i,j}, \ldots, H_{i+2,j}, \ldots$, at deeper depth from the primary surface is wider than the diameter of the openings at a level of the primary surface as shown in FIG. 11C. For achieving the inverse tapered shape, the etching gas may be changed from the etching gas employed in the RIE.

Figure 11D:
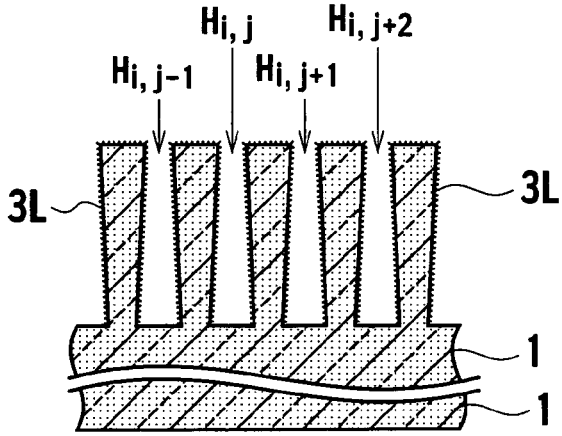
FIG. 11D is a further subsequent process flow cross sectional view showing the electron-emitting layer of the first discharge electrode according to the second embodiment after the process stage shown in FIG. 11C.

(d) Subsequently, the etching chamber is vacuum evacuated. Hydrogen gas is introduced into the etching chamber, and the entire surface of the wide bandgap semiconductor substrate 1 is subjected to hydrogen plasma processing. Through hydrogen plasma processing, as shown in FIG. 11D, a hydrogen adsorbed layer 3L is formed on the surface of the wide bandgap semiconductor substrate 1 including sidewalls of the inverse tapered shaped fine pores $H_{i-1,j}, \ldots, H_{i,j}, \ldots, H_{i+2,j}, \ldots$, and dangling bonds on the surface of the wide bandgap semiconductor substrate 1 are terminated with bonds of hydrogen atoms 3.

As with the first discharge electrode according to the first embodiment, the step of terminating the dangling bonds on the surface of the wide bandgap semiconductor substrate 1 with atomic hydrogen 3 may be carried out just before or as part of a step of integrating the first discharge electrode in a sealed-off tube 9, which implements a discharge lamp. In other words, the product of the first discharge electrode can be shipped either in a form in which the dangling bonds at the surfaces of the wide bandgap semiconductor 1, including the sidewalls of the inverse tapered shaped fine pores $H_{i-1,j}, \ldots, H_{i,j}, \ldots, H_{i+2,j}, \ldots$, are terminated by bonds of hydrogen atoms 3, or in a form in which the dangling bonds are not terminated by the bonds of hydrogen atoms 3.

According to the first discharge electrode of the second embodiment, in the hydrogen-terminated structure of the dangling bonds on the surface of the wide bandgap semiconductor substrate 1, even if hydrogen at the primary surfaces (top end faces) of the electron-emitting layer desorbs due to noble-gas ion-bombardment, the hydrogen-terminated surface of the dangling bonds on the sidewall surfaces in the fine pores $H_{i-1,j}, \ldots, H_{i,j}, \ldots, H_{i+2,j}, \ldots$ may be maintained, thereby maintaining a highly efficient NEA surface with a long lifetime. Furthermore, the selection of distance T between respective fine pores $H_{i-1,j}, \ldots, H_{i,j}, \ldots, H_{i+2,j}, \ldots$ so that the excited electrons, generated in the wide bandgap semiconductor, can reach the NEA surfaces can facilitate effective emission of the excited electrons to the outside of the electron-emitting layer. Accordingly, reliable cathode characteristics are provided without reducing electron emission efficiency.

Therefore, according to the first discharge electrode of the second embodiment, the cathode voltage drop can be considerably reduced compared to the earlier metallic cathode by utilizing the highly efficient secondary-electron emission from the hydrogen-terminated surface, at which dangling bonds are terminated by bonds of hydrogen atoms 3.

Third Embodiment

Figure 12:
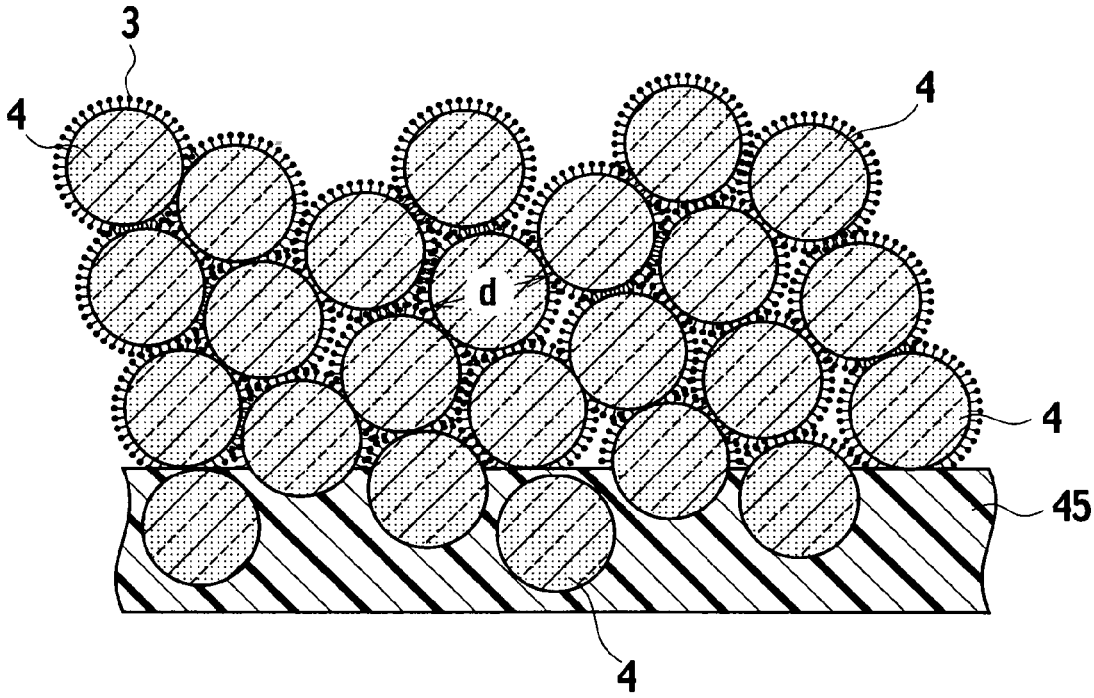
FIG. 12 is a cross sectional view illustrating part of an electron-emitting layer of a first discharge electrode, according to a third embodiment of the present invention.

FIG. 12 is a fragmentary bird's eye view illustrating part of an electron-emitting layer 2*a* in a first discharge electrode of a discharge lamp, according to the third embodiment of the present invention, which may corresponds to portion A in FIG. 1. The electron-emitting layer 2*a* is formed of a wide bandgap semiconductor and provided on a supporting base 45. The electron-emitting layer 2*a* is implemented by a plurality of protrusions, at least part of the surface of each of the protrusions is unseen from a perpendicular direction to a top surface of the electron-emitting layer 2*a* above the top surface of the electron-emitting layer 2*a*. As shown in FIG. 12, the protrusions are implemented by a plurality of wide bandgap semiconductor grains 4, each having a diameter "d", agglomerated on the supporting base 45. Bonds of hydrogen atoms 3 terminate the dangling bonds on surfaces of respective wide bandgap semiconductor grains 4.

Diameter "d" of the respective wide bandgap semiconductor grains 4 is set to a value not larger than double the electron mean free path λ in a wide bandgap semiconductor. Namely, because the distance for excited electrons, which are generated in the wide bandgap semiconductor, is selected within the electron mean free path λ so that the excited electrons can reach the NEA surfaces of the electron-emitting layer 2*a*, the effective emission of the excited electrons to the outside of the electron-emitting layer is achieved. As described in the first embodiment, since the electron mean free path λ in the wide bandgap semiconductors is approximately one to ten micrometers, diameter "d" of the respective wide bandgap semiconductor grains 4 may be approximately two to twenty micrometers, or less.

Although the diameter "d" is uniquely defined for spherical grain, it is a mean diameter $d_{mean}$ defined by an average of values for three orthogonal axes as long as the wide bandgap semiconductor grain 4 has an arbitrary three-dimensional shape. When the wide bandgap semiconductor grain 4 has diameters $d_1$, $d_2$, and $d_3$ of three orthogonal axes, $d_{mean}$ can be provided by:

$$d_{mean}=(d_1+d_2+d_3)/3 \quad (6)$$

More generally, when the wide bandgap semiconductor grain 4 are three-dimensional substances having n diameters $d_1$, $d_2$, $d_3$, . . . , $d_n$, mean diameter $d_{mean}$ may be defined by:

$$d_{mean}=(d_1+d_2+d_3+\ldots+d_n)/n \quad (7)$$

Namely, the mean diameter $d_{mean}$ is defined by an average value of n diameters. Note that in a theoretical consideration, a certain result can be expected if the minimum value among the n diameters $d_1$, $d_2$, $d_3$, . . . , $d_n$ is not larger than twice the electron mean free path λ in the wide bandgap semiconductors. However, considering efficiency, it is preferable that the mean diameter $d_{mean}$ of the wide bandgap semiconductor grains 4 is not larger than twice the electron mean free path λ in the wide bandgap semiconductors.

When the wide bandgap semiconductor grains 4 are single crystal grains, there is effective improvement in secondary-electron emission efficiency, because any loss in the wide bandgap semiconductor grains 4 due to grain boundary is not generated.

A fabrication method for the electron-emitting layer 2*a* of the first discharge electrode, according to the third embodiment of the present invention, is described with reference to FIGS. 13A and 13B. Note that the fabrication method for the electron-emitting layer 2*a* described forthwith is merely an example, and the present invention may naturally be implemented by other various fabrication methods including the modification.

Figure 13A:
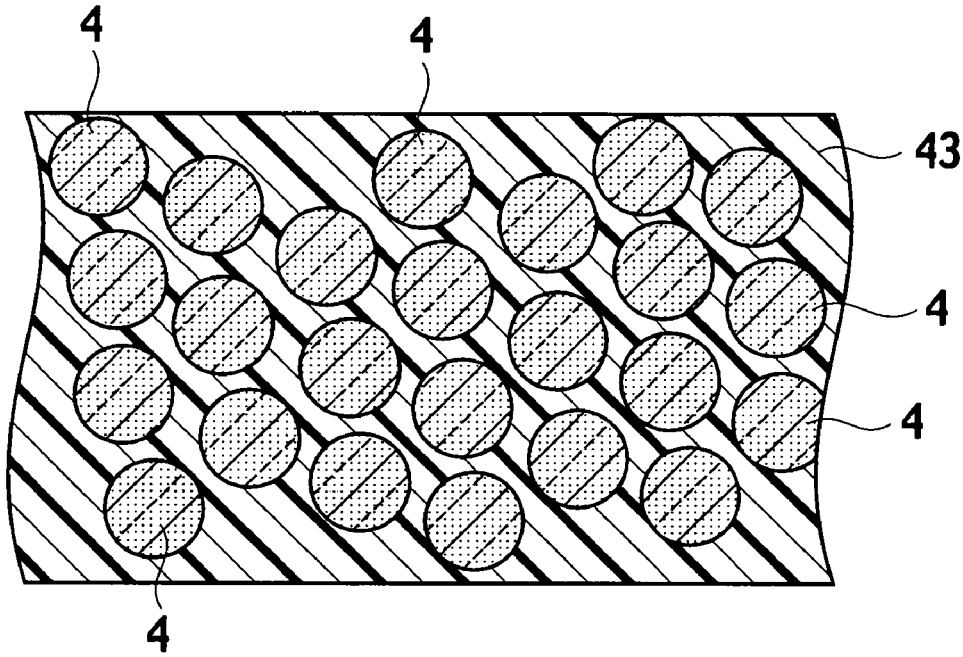
FIG. 13A is a process flow cross sectional view showing an intermediate product of the electron-emitting layer of the first discharge electrode according to the third embodiment of the present invention, explaining a manufacturing method of the first discharge electrode according to the third embodiment.

(a) To begin with, as shown in FIG. 13A, the wide bandgap semiconductor grains 4 such as diamond particles are bound with an appropriate binder 43. Carbon-based pitch, various metals or the like may implement the binder 43.

Figure 13B:
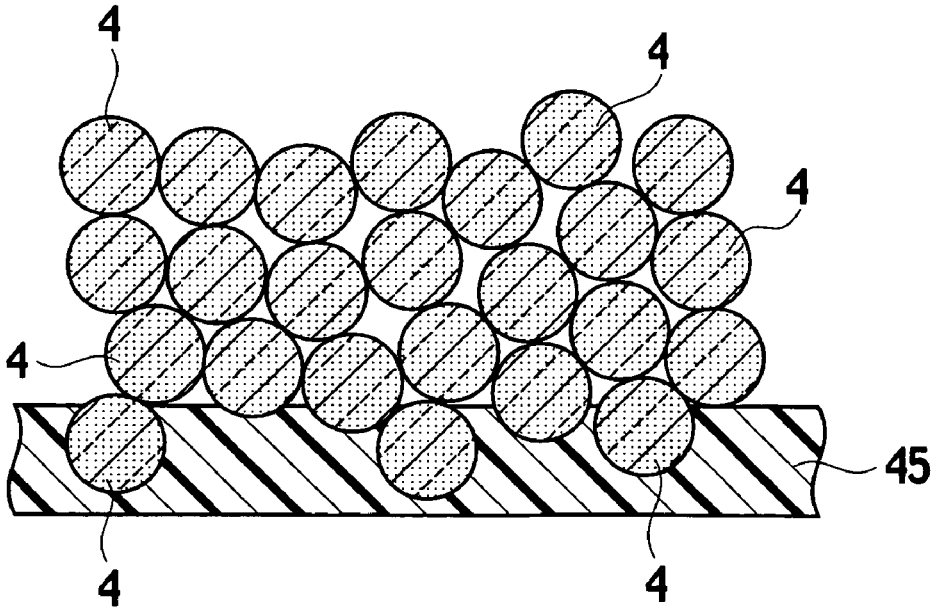
FIG. 13B is a subsequent process flow cross sectional view showing the intermediate product of the electron-emitting layer of the first discharge electrode according to the third embodiment after the process stage shown in FIG. 13A.

(b) Next, while heating to a high temperature, as shown in FIG. 13B, the binder 43 is removed as needed so as to bond (join) and agglomerate the wide bandgap semiconductor grains 4. As a result of removing part of the binder 43, the remnant tabular binder 43 at the bottom becomes a supporting base 45. Between the agglomerated wide bandgap semiconductor grains 4, porous gaps develop. Wet etching using acid solution or dry etching such as plasma etching may be used so as to remove part of the binder 43 as shown in FIG. 13B.

(c) Aside from the joined sites of the wide bandgap semiconductor grains 4, dangling bonds on the exposed surface of the wide bandgap semiconductor grains 4 are subjected to hydrogen-termination treatment so as to be terminated by bonds of atomic hydrogen 3, providing a NEA surface of the wide bandgap semiconductor grains 4. As a result, formation of the electron-emitting layer 2*a* of the first discharge electrode shown in FIG. 12 is completed.

Similar to the first discharge electrodes according to the first and the second embodiment, the process step of terminating the dangling bonds at the surfaces of the wide bandgap semiconductor grains 4 using atomic hydrogen 3 may be carried out just before or as part of a step of integrating the first discharge electrode in a sealed-off tube 9, which implements a discharge lamp. In other words, the product of the first discharge electrode can be shipped either in a form in which the dangling bonds at the surfaces of the wide bandgap semiconductor grains 4 are terminated by bonds of hydrogen atoms 3, or in a form in which the dangling bonds are not terminated by the bonds of hydrogen atoms 3.

Note that the wide bandgap semiconductor grains 4 with diameter "d" of approximately two to twenty micrometers or less may be grown through CVD by levitating minute grains of the wide bandgap semiconductors in a vertical CVD furnace, with acoustic energy, electrostatic energy, aerodynamic energy, plasma energy, or a combined energy source. In the vertical CVD furnace, the minute grains serving as seeds are levitated, and then the levitated minute grains are dropped so as to grow wide bandgap semiconductors on the seeds.

For example, in a CVD for diamond particles, by supplying methane ($CH_4$) gas as a source gas in addition to hydrogen ($H_2$) gas as a carrier gas while levitating and dropping the seeds implemented by minute diamond particles, at growth temperature of about 850 degrees Centigrade in the vertical CVD furnace, single crystals of diamond particles 4 with diameter "d" of approximately two to twenty micrometers or less may be obtained.

When the electron-emitting layer 2*a* of the first discharge electrode according to the third embodiment of the present invention, which has a structure implemented by agglomerated wide bandgap semiconductor grains 4, is assembled in a discharge lamp, even if hydrogen desorbs from the hydrogen-terminated wide bandgap semiconductor grains 4 located on the primary surface of the electron-emitting layer 2*a* of the first discharge electrode, part of the hydrogen-terminated surface of the wide bandgap semiconductor grains 4, which are located in lower portion of the agglomerated structure and are not easily bombarded with noble gas ions accelerated by the electric field, can be maintained, thus maintaining a highly efficient NEA surface with a long lifetime.

Furthermore, with the electron-emitting layer 2*a*, according to the third embodiment of the present invention, since diameter "d" of the wide bandgap semiconductor grains 4 is set to a value not larger than approximately twice the electron mean free path λ in the wide bandgap semiconductors, efficient emission of the excited electrons, which are generated in the wide bandgap semiconductor to the outside of the electron-emitting layer is possible. Accordingly, reliable cathode characteristics are provided without reducing electron emission efficiency.

In other words, according to the discharge lamp of the third embodiment of the present invention, the cathode voltage drop can be considerably reduced compared to the earlier metallic cathode by utilizing the highly efficient secondary-electron emission from the hydrogen-terminated surfaces of the wide bandgap semiconductor grains 4.

Other Embodiments

Various modifications will become possible for those skilled in the art after receiving the teaching of the present disclosure without departing from the scope thereof. For example, the structures of the electron-emitting layers described in the first through the third embodiments may be applied to electron-emitting layers 2 in an external electrode-type discharge lamp as shown in FIG. 14.

Figure 14:
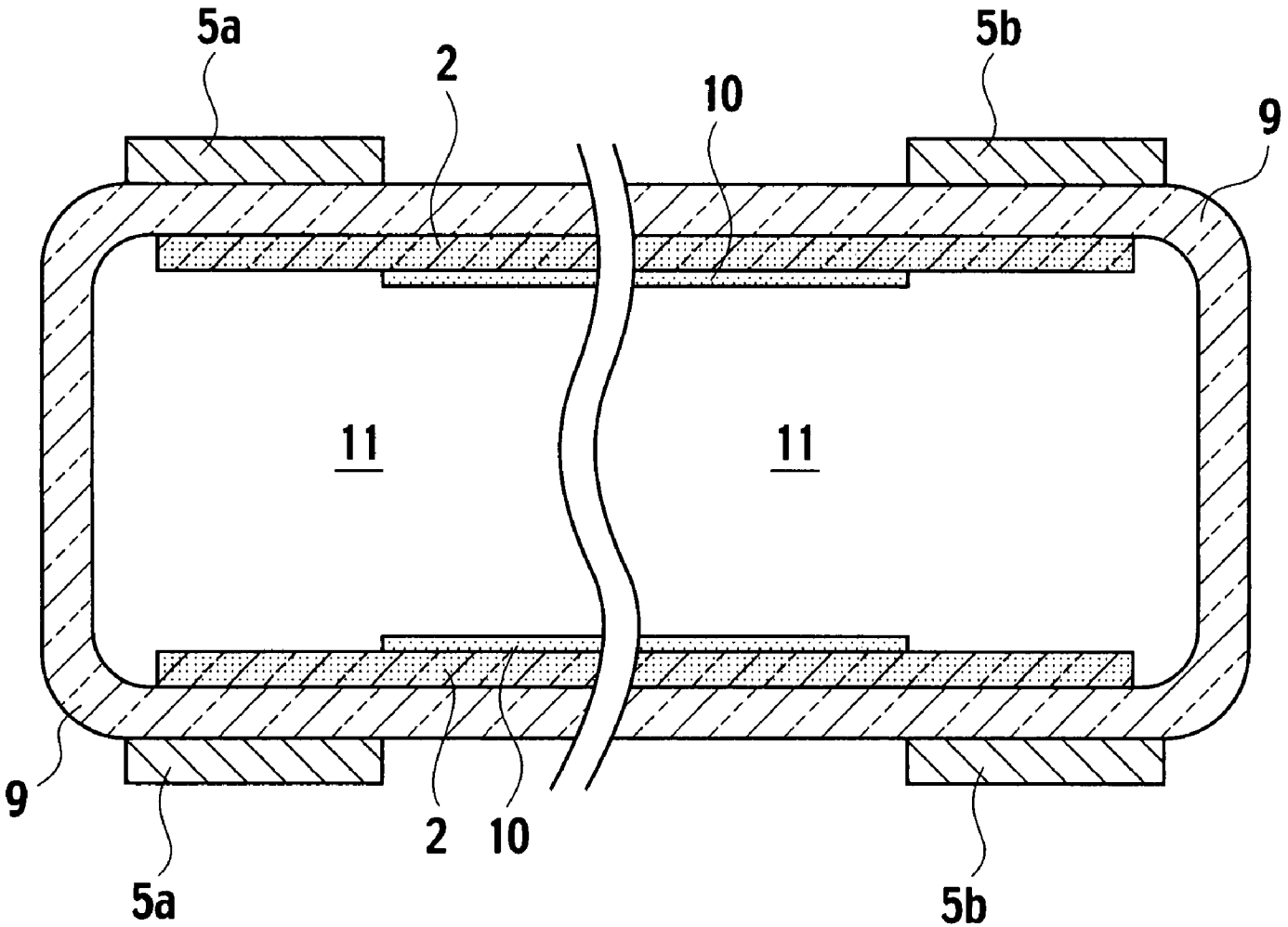
FIG. 14 is a schematic cross-section describing an outline of an external electrode-type discharge lamp, according to another embodiment of the present invention.

In other words, as shown in FIG. 14, the discharge lamp may be implemented by a sealed-off tube 9, an electron-emitting layer 2, which is made of cylindrical wide bandgap semiconductor layers, formed on the inner surface of the sealed-off tube 9, a cylindrical fluorescent film 10 coated on the electron-emitting layer 2, and a cylindrical first external discharge electrode 5*a* and a cylindrical second external discharge electrode 5*b* mounted on both sides of the outer surface of the sealed-off tube 9. For example, a diamond layer with a thickness of 1.5 to five micrometers, preferably approximately two to four micrometers are available for the electron-emitting layer 2, which is made of a wide bandgap semiconductor layer in FIG. 14. Although omitted from the drawing, the detailed configuration of the electron-emitting layer 2 is the substantially same as given in FIGS. 1 through 3. Namely, the electron-emitting layer 2 encompasses a supporting base, which is formed of wide bandgap semiconductor, and wide bandgap semiconductor pillars $R_{i-1,j-2}$, $R_{i-1,j-1}$, $R_{i-1,j}$, $R_{i-1,j+1}$, . . . , $R_{i,j-2}$, $R_{i,j-1}$, $R_{i,j}$, $R_{i,j+1}$, . . . are provided on the supporting base. The wide bandgap semiconductor pillars $R_{i-1,j-2}$, $R_{i-1,j-1}$, $R_{i-1,j}$, $R_{i-1,j+1}$, . . . , $R_{i,j-2}$, $R_{i,j-1}$, $R_{i,j}$, $R_{i,j+1}$, . . . are separated by grooves, the grooves running vertically and horizontally so as to form a matrix, where dangling bonds on the surface of the wide bandgap semiconductor layer exposed at the sidewalls of the wide bandgap semiconductor pillars $R_{i,j-2}$, $R_{i,j-1}$, $R_{i,j}$ are terminated by bonds of hydrogen atoms 3, so as to implement the electron-emitting layer 2. The top end faces of the wide bandgap semiconductor pillars $R_{i-1,j-2}$, $R_{i-1,j-1}$, $R_{i-1,j}$, $R_{i-1,j+1}$, . . . , $R_{i,j-2}$, $R_{i,j-1}$, $R_{i,j}$, $R_{i,j+1}$, . . . implement the top surfaces of the electron-emitting layer 2.

Alternatively, the electron-emitting layer 2 may encompass a supporting base 45, and wide bandgap semiconductor grains 4 agglomerated on the supporting base 45 as shown in FIG. 12, the dangling bonds at surfaces of the wide bandgap semiconductor grains 4 are terminated by bonds of hydrogen atoms 3.

It is preferable that the first external discharge electrode 5*a* and the second external discharge electrode 5*b* are respectively made of a refractory metal such as tungsten (W). A discharge gas 11 is filled in the sealed-off tube 9. For example, hydrogen ($H_2$) gas and argon (Ar) gas or a mixed noble gas for facilitating electric discharge is sealed in the sealed-off tube 9 with a pressure of 8 kPa. A mixed gas of gases selected from, for example, Ar, neon (Ne), and xenon (Xe) is available as the mixed noble gas. Partial pressure of the hydrogen gas is 0.4 kPa, for example. The discharge gas 11 is filled in both ends of the sealed-off tube 9. Electron-emitting layers 2 are not provided on both ends of the sealed-off tube 9 for easier sealing of the sealed-off tube 9.

As shown in FIG. 14, a single cylindrical electron-emitting layer 2 is formed on inner surface of the sealed-off tube 9 opposite to the first external discharge electrode 5*a* and to the second external discharge electrode 5*b* via the sealed-off tube 9. The wide bandgap semiconductors such as diamond layers are material with a high electron emitting efficiency. The hydrogen within the discharge gas 11 terminates the surface of the wide bandgap semiconductor so as to allow continuous electric discharge or continuous emotion of a large amount of electrons to an electric discharge space. A high-frequency voltage of approximately 1500 V at a frequency of 40 kHz is then applied between the first external discharge electrode 5*a* and the second external discharge electrode 5*b*. When one of the first external discharge electrode 5*a* and the second external discharge electrode 5*b* acts as an emitter (cathode), the other acts as a counter electrode (anode). By the application of the high-frequency voltage, a strong electric field is established in the space within the sealed-off tube 9, and electrons are then emitted from the surfaces of the electron-emitting layer 2 by the strong electric field. At the time, since the hydrogen within the discharge gas 11 terminates the surfaces of the electron-emitting layer 2, effective emission of electrons into the discharge space is possible. The emitted electrons move to the counter electrode (anode) side, commencing electric discharge.

In other words, in the discharge lamp according to other embodiments of the present invention, since ions accelerated by strong electric fields perpendicular to the primary surfaces of the electron-emitting layer 2, which face the first external discharge electrode 5*a* via the sealed-off tube 9, collide into the primary surfaces (top end faces) of the electron-emitting layer 2, even if the hydrogen 3 terminating the dangling bonds on the top end faces desorbs, hydrogen-terminated surfaces remain on the sidewalls of the wide bandgap semiconductor pillars $R_{i-1,j-2}$, $R_{i-1,j-1}$, $R_{i-1,j}$, $R_{i-1,j+1}$, . . . , thereby reducing as a whole the probability of ion-bombarded hydrogen-desorption. Since it is difficult for the hydrogen 3 to desorb, the electron affinity $\chi$ at respective sidewalls of the wide bandgap semiconductor pillars $R_{i-1,j-2}$, $R_{i-1,j-1}$, $R_{i-1,j}$, $R_{i-1,j+1}$, . . . can be kept small, and a condition where electrons can easily be emitted can be maintained. In addition, secondary-electron emission to the outside of the electron-emitting layer through the Auger neutralizing process, based upon the potential energy of the bombarding ions may be effectively carried out.

While a single cylindrical electron-emitting layer 2 is formed in the sealed-off tube 9 extending along the axis of the sealed-off tube 9 from a location opposing the first external discharge electrode 5*a* to a location opposing the second external discharge electrode 5*b* in FIG. 14, the electron-emitting layer 2 is basically needed to be formed on inner surface of the sealed-off tube 9 that oppose the first external discharge electrode 5*a* and the second external discharge electrode 5*b*. Therefore, the single cylindrical electron-emitting layer 2 may be divided into two electron-emitting layers 2 by a zone disposed at the location of the fluorescent film 10. In addition, as shown in FIG. 14, a double-layer structure implemented by the cylindrical electron-emitting layer 2 and the cylindrical fluorescent film 10 on the inside of the cylindrical electron-emitting layer 2 is not required, and may have a structure where the fluorescent film 10 is directly coated on the inner surface of the sealed-off tube 9 between two electron-emitting layers 2 disposed on both sides.

Thus, the present invention of course includes various embodiments and modifications and the like which are not detailed above. Therefore, the scope of the present invention will be defined in the following claims.

What is claimed is:

1. A discharge lamp comprising:

a sealed-off tube filled with a discharge gas; and a discharge electrode provided in the sealed-off tube comprising:

a supporting base having a flat top surface, formed of a wide bandgap semiconductor, wherein an electron-emitting layer is provided at an upper portion of the supporting base, implemented by a plurality of protrusions separated by a plurality of grooves cut from the top surface toward a bottom surface of the supporting base, wherein the depth of the grooves are smaller than a thickness of the supporting base, the top end surfaces of the protrusions are parallel to the top surface of the supporting base, for each protrusion viewed from above a perpendicular center line from the plane of the top end surface of the protrusion, at least a part of sidewalls of the protrusion are unseen, and dangling bonds of the wide bandgap semiconductor at the unseen sidewalls are terminated with hydrogen atoms.

2. The discharge lamp of claim 1, wherein each of the protrusions are implemented by a pillar defined by the top end surface and flat sidewalls, and each of the sidewalls are in parallel each other.

3. The discharge lamp of claim 1, wherein a two dimensional shape of the top end surface viewed from the perpendicular direction has a size of an order of electron mean free path in the wide bandgap semiconductor.

4. The discharge lamp of claim 1, wherein an average of a plurality of distances measured between opposite sides of a two dimensional shape of the top end face viewed from the perpendicular direction is not larger than twice of electron mean free path in the wide bandgap semiconductor.

5. The discharge lamp of claim 1, wherein the plurality of grooves are defined by a plurality of pores provided at the upper portion of the supporting base so that a couple of the pores sandwich one of the protrusions in a cross-sectional view.

6. The discharge lamp of claim 1, wherein the discharge electrode further comprises:

a bottom electrode formed on the bottom surface of the supporting base;

a refractory metal plate formed on the bottom surface of the bottom electrode; and a refractory metal rod electrically connected to the refractory metal plate.

7. The discharge lamp of claim 1, wherein the discharge electrode further comprises:

a plurality of top contact films on the top surface of the supporting base, making ohmic contacts with the supporting base;

a plurality of bottom contact films on the bottom surface of the supporting base, making ohmic contacts with the supporting base; and a plurality of stem leads electrically connected to the supporting base via the top and bottom contact films.

8. The discharge lamp of claim 7, wherein the discharge electrode further comprises amorphous contact regions formed in the top surface of the supporting base just below the top contact films.

9. A discharge lamp comprising:

a sealed-off tube filled with a discharge gas;

an electron-emitting layer including a supporting base having a flat top surface, formed of a wide bandgap semiconductor and provided on the inner surface of the sealed-off tube, wherein a plurality of protrusions are provided at an upper portion of the supporting base, wherein the protrusions are separated by a plurality of grooves cut from the top surface toward a bottom surface of the supporting base, the depth of the grooves are smaller than a thickness of the supporting base, the top end surfaces of the protrusions are parallel to the top surface of the supporting base, for each protrusion viewed from above a perpendicular center line from the plane of the top end surface of the protrusion, sidewalls of the protrusion are unseen, dangling bonds of the wide bandgap semiconductor at the sidewalls are terminated with hydrogen atoms; and an external discharge electrode provided on the outer surface of the sealed-off tube, opposing to the electron-emitting layer.

10. A discharge electrode configured to be assembled in a sealed-off tube of a discharge lamp, comprising:

a supporting base having a flat top surface, formed of a wide bandgap semiconductor, wherein an electron-emitting layer is provided at an upper portion of the supporting base, implemented by a plurality of protrusions separated by a plurality of grooves cut from the top surface toward a bottom surface of the supporting base, wherein the depth of the grooves are smaller than a thickness of the supporting base, the top end surfaces of the protrusions are parallel to the top surface of the supporting base, for each protrusion viewed from above a perpendicular center line from the plane of the top end surface on the protrusion, at least a part of sidewalls of the protrusion are unseen, and dangling bonds of the wide bandgap semiconductor at the unseen sidewalls are terminated with hydrogen atoms.

11. The discharge electrode of claim 10, wherein each of the protrusions are implemented by a pillar defined by the top end surface and flat sidewalls, and each of the sidewalls are in parallel each other.

12. The discharge electrode of claim 10, wherein an average of a plurality of distances measured between opposite sides of a two dimensional shape of the top end surface viewed from the perpendicular direction is not larger than twice of electron mean free path in the wide bandgap semiconductor.

13. The discharge electrode of claim 10, wherein the supporting base is formed of the wide bandgap semiconductor.

14. The discharge electrode of claim 13, further comprising:

a bottom electrode formed on the bottom surface of the supporting base;

a refractory metal plate formed on the bottom surface of the bottom electrode; and a refractory metal rod electrically connected to the refractory metal plate.

15. The discharge electrode of claim 13, further comprising:

a plurality of top contact films on the top surface of the supporting base, making ohmic contacts with the supporting base;

a plurality of bottom contact films on the bottom surface of the supporting base, making ohmic contacts with the supporting base; and a plurality of stem leads electrically connected to the supporting base via the top and bottom contact films.

16. The discharge electrode of claim 15, further comprising amorphous contact regions formed in the top surface of the supporting base just below the top contact films.

* * * * *